US011315494B2

(12) United States Patent
Kang et al.

(10) Patent No.: US 11,315,494 B2
(45) Date of Patent: Apr. 26, 2022

(54) PIXEL CIRCUIT AND DISPLAY DEVICE USING THE SAME

(71) Applicant: LG Display Co., Ltd., Seoul (KR)

(72) Inventors: Min Ha Kang, Paju-si (KR); Ho Young Lee, Paju-si (KR); Jae Sung Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/384,412

(22) Filed: Jul. 23, 2021

(65) Prior Publication Data

US 2022/0059032 A1 Feb. 24, 2022

(30) Foreign Application Priority Data

Aug. 20, 2020 (KR) ..... 10-2020-0104740

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0876* (2013.01)

(58) Field of Classification Search
CPC .. G09G 3/3233; G09G 3/3258; G09G 3/3266; G09G 2300/0861; G09G 2300/0819; G09G 2320/0247; G09G 2320/0233; G09G 2320/043; G09G 2330/021; G09G 2340/0435; G09G 2310/08; G09G 2310/061; G09G 2310/0297; G09G 2360/16
See application file for complete search history.

(56) References Cited

U.S. PATENT DOCUMENTS

2014/0300281 A1* 10/2014 Chaji ..... G09G 3/3266 315/161
2017/0098413 A1* 4/2017 Lee ..... G11C 19/28
2018/0190197 A1* 7/2018 Chang ..... G09G 3/3233
2019/0164495 A1* 5/2019 Kubota ..... G09G 3/3233
2021/0193036 A1* 6/2021 Huang ..... G09G 3/3225

FOREIGN PATENT DOCUMENTS

KR 10-1433246 B1 8/2014
KR 10-2019-0053552 A 5/2019

* cited by examiner

*Primary Examiner* — Dong Hui Liang
(74) *Attorney, Agent, or Firm* — Seed IP Law Group LLP

(57) ABSTRACT

The present disclosure relates to a pixel circuit and a display device using the same. The pixel circuit includes a first switch element configured to connect a first node to a third node in a sampling step, a second switch element configured to supply a data voltage to a second node in the sampling step, a third switch element configured to supply a pixel driving voltage to the second node in a emission step after the sampling step, a fourth switch element configured to connect the third node to an anode of a light-emitting element in the emission step, a first capacitor connected to the first node, a second capacitor connected between the third node and the anode of the light-emitting element, and a third capacitor connected between the anode and the cathode of the light-emitting element.

15 Claims, 16 Drawing Sheets

PIXEL CIRCUIT AND DISPLAY DEVICE USING THE SAME

CROSS-REFERENCE TO RELATED APPLICATION

This application claims priority to and the benefit of Korean Patent Application No. 10-2020-0104740, filed on Aug. 20, 2020, the disclosure of which is incorporated herein by reference in its entirety.

BACKGROUND

Technical Field

The present disclosure relates to a display device in which a pixel driving voltage is supplied to pixel circuits of all pixels.

Description of the Related Art

Electroluminescent display devices are broadly classified into inorganic light-emitting display devices and organic light-emitting display devices according to a material of an emission layer. Organic light-emitting display devices in an active matrix include organic light-emitting diodes (hereinafter, referred to as OLEDs) configured to self-emit light and have advantages such as a high response speed, a high luminous efficiency, a high luminance, and a wide viewing angle. In the organic light-emitting display device, the OLED is formed in each of pixels. The organic light-emitting display devices may not only have a high response speed, a high luminous efficiency, a high luminance, and a wide viewing angle but also express a black gradation in complete black, and thus may have a high contract ratio and color reproduction ratio.

Organic light-emitting display devices do not require a backlight unit and may be implemented on a plastic substrate, a thin glass substrate, or a metal substrate which is made of a flexible material. Accordingly, flexible displays can be implemented using organic light-emitting display devices.

In flexible displays, the size and shape of a screen are variable in a manner of rolling, folding, or bending a display panel. The flexible displays may be implemented as rollable displays, bendable displays, foldable displays, slideable displays, or the like. Such flexible displays may be applied not only to mobile devices such as smartphones and tablet personnel computers (PCs) but also to televisions (TVs), vehicle displays, and wearable devices, and application fields thereof are expanding.

Pixels of organic light-emitting display devices each include an OLED, a driving element that drives the OLED by controlling a current flowing in the OLED according to a gate-source voltage (Vgs), and a storage capacitor that maintains a gate voltage of the driving element.

The driving element may be implemented as a transistor. In order to make image quality of an entire screen of the organic light-emitting display device uniform, the driving elements of all pixels should have uniform electrical characteristics. However, due to a process deviation and an element characteristic deviation caused in a manufacturing process of a display panel, the driving elements of the pixels may have a difference in electrical characteristics, and the difference may be increased as a driving time of the pixels elapses. In order to compensate for an electrical characteristic deviation between the driving elements of the pixels, internal compensation technology or external compensation technology may be applied to the organic light-emitting display device.

In the internal compensation technology, a threshold voltage of the driving element is sampled for each subpixel using an internal compensation circuit embedded in each of the pixels, thereby compensating for the gate-source voltage (Vgs) of the driving element by as much as the threshold voltage. In the external compensation technology, a current or voltage of the driving elements, which varies according to the electrical characteristics of the driving elements, is sensed in real time using an external compensation circuit. In the external compensation technology, pixel data (digital data) of an input image is modulated by as much as an electrical characteristic deviation (or change) of the driving element sensed for each pixel, thereby compensating for the electrical characteristic deviation (or change) of the driving element in real time in each of the pixels.

BRIEF SUMMARY

As the efficiency of an organic light-emitting diode (OLED) is improved, a current flowing to the OLED in a low gradation may be decreased. This is because a time for a parasitic capacitance of the OLED to be charged is delayed due to a low current. Therefore, in an OLED with high efficiency, low gradation expression characteristics may be degraded, and a flicker in which luminance periodically fluctuates may be visible in a low speed driving mode.

One or more embodiments of the present disclosure may solve the above-mentioned problems and other technical problems in the related art.

The present disclosure is directed to providing a pixel circuit with improved low gradation expression characteristics and reduced a flicker in a low speed driving mode, and a display device using the same.

It should be noted that technical benefits of the present disclosure are not limited to the above-described benefits, and other benefits of the present disclosure will be apparent to those skilled in the art from the following descriptions.

According to an aspect of the present disclosure, there is provided a pixel circuit including a light-emitting element including an anode and a cathode, a driving element which includes a gate electrode connected to a first node, a first electrode connected to a second node, and a second electrode connected to a third node and which supplies a current to the light-emitting element, a first switch element configured to connect the first node to the third node in a sampling step, a second switch element configured to supply a data voltage to the second node in the sampling step, a third switch element configured to supply a pixel driving voltage to the second node in a emission step after the sampling step, a fourth switch element configured to connect the third node to the anode of the light-emitting element in the emission step, a first capacitor connected to the first node, a second capacitor connected between the third node and the anode of the light-emitting element, and a third capacitor connected between the anode and the cathode of the light-emitting element.

According to an aspect of the present disclosure, there is provided a display device including the pixel circuit.

According to an aspect of the present disclosure, there is provided a display device comprising: a data driver configured to supply data voltages to data lines; a gate driver configured to supply an (N−1)th scan signal generated as a pulse of a gate-on voltage to a first gate line in an initialization step, supply an Nth scan signal generated as the pulse of the gate-on voltage to a second gate line in a sampling step after the initialization step, and supply an emitting signal generated as the gate-on voltage to a third gate line in a emission step after the sampling step, wherein N is a positive integer which is greater than or equal to 1; a power source configured to output a pixel driving voltage and a low potential power voltage and an initialization voltage which are lower than the pixel driving voltage; and a red subpixel, a green subpixel, and a blue subpixel including pixel circuits connected to the data lines and the first gate line to the third gate line, wherein the pixel circuit includes: a light-emitting element including an anode and a cathode; a driving element which includes a gate electrode connected to a first node, a first electrode connected to a second node, and a second electrode connected to a third node and which supplies a current to the light-emitting element; a first switch element configured to connect the first node to the third node in the sampling step; a second switch element configured to supply the data voltage to the second node in the sampling step; a third switch element configured to supply the pixel driving voltage to the second node in the emission step after the sampling step; a fourth switch element configured to connect the third node to the anode of the light-emitting element in the emission step; a first capacitor connected to the first node; a second capacitor connected between the third node and the anode of the light-emitting element; and a third capacitor connected between the anode and the cathode of the light-emitting element.

DETAILED DESCRIPTION

Figure 1:
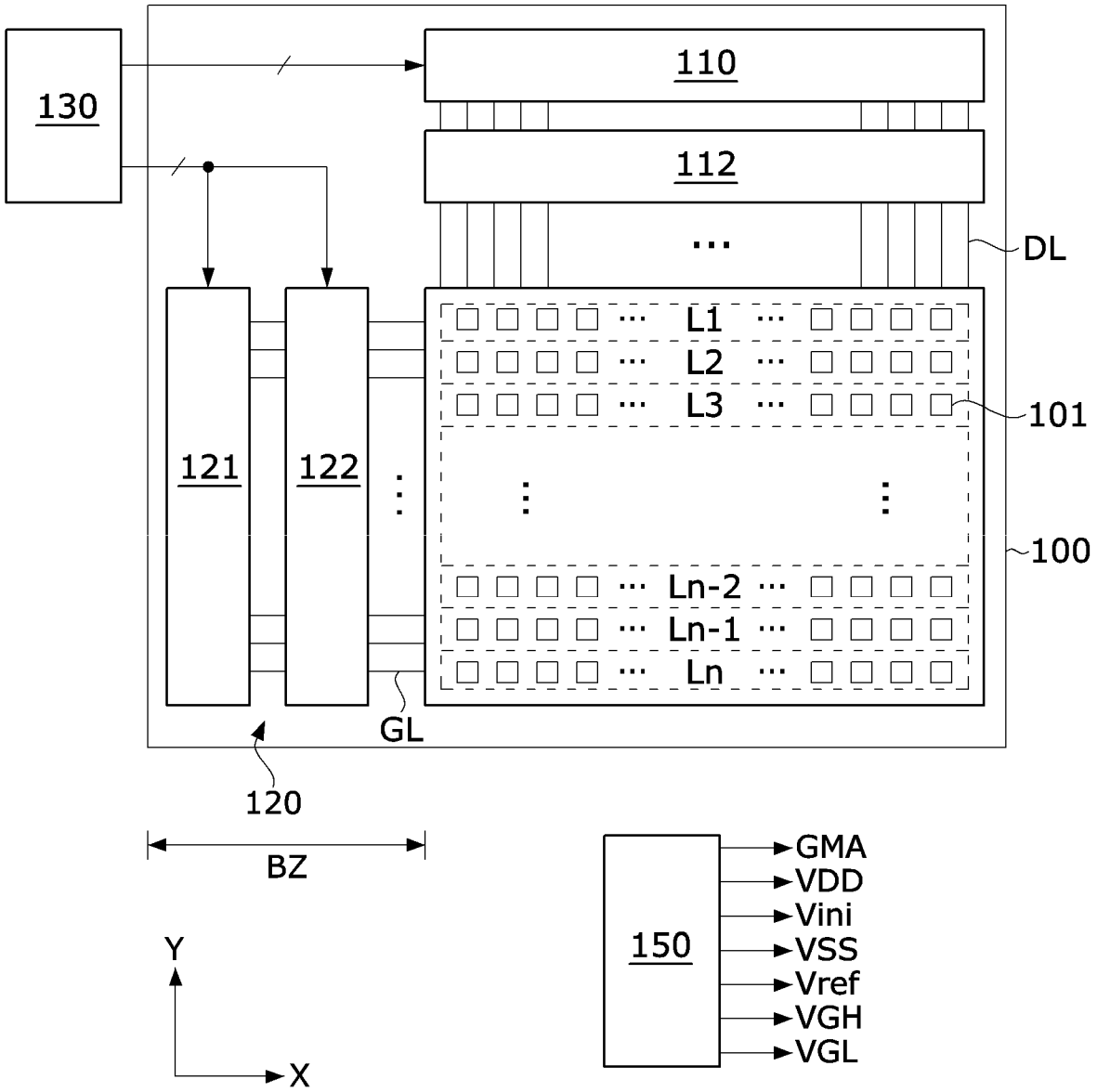
FIG. 1 is a block diagram illustrating a display device according to an embodiment of the present disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies may be omitted to avoid unnecessarily obscuring the subject matter of the present disclosure.

The terms such as "comprising," "including," and "having" used herein are generally intended to allow other components to be added unless the terms are used with the term "only." Any references to singular may include plural unless expressly stated otherwise.

Components are interpreted to include an ordinary error range even if not expressly stated.

When the position relation between two components is described using the terms such as "on," "above," "below," and "next," one or more components may be positioned between the two components unless the terms are used with the term "immediately" or "directly."

The terms "first," "second," and the like may be used to distinguish components from each other, but the functions or structures of the components are not limited by ordinal numbers or component names in front of the components.

The following embodiments can be partially or entirely bonded to or combined with each other and can be linked and operated in technically various ways. The embodiments can be carried out independently of or in association with each other.

In a display device of the present disclosure, a pixel circuit may include at least one of an n-channel transistor and a p-channel transistor. Transistors may be implemented as oxide thin film transistors (oxide TFTs) including an oxide semiconductor, low temperature polysilicon (LTPS) TFTs including low temperature polysilicon, or the like. Further, each of the transistors may be implemented as a p-channel TFT or an n-channel TFT. In embodiments, descriptions will be given based on an example in which the transistors of the pixel circuit are implemented as the p-channel TFTs, but the present disclosure is not limited thereto.

A transistor is a three-electrode element including a gate, a source, and a drain. The source is an electrode that supplies carriers to the transistor. In the transistor, carriers start to flow from the source. The drain is an electrode through which carriers exit from the transistor. In a transistor, carriers flow from a source to a drain. In the case of an n-channel transistor, since carriers are electrons, a source voltage is a voltage lower than a drain voltage such that electrons may flow from a source to a drain. The n-channel transistor has a direction of a current flowing from the drain to the source. In the case of a p-channel transistor (p-channel metal-oxide semiconductor (PMOS)), since carriers are holes, a source voltage is higher than a drain voltage such that holes may flow from a source to a drain. In the p-channel transistor, since holes flow from the source to the drain, a current flows from the source to the drain. It should be noted that a source and a drain of a transistor are not fixed. For example, a source and a drain may be changed according to an applied voltage. Therefore, the disclosure is not limited due to a source and a drain of a transistor. In the following description, a source and a drain of a transistor will be referred to as a first electrode and a second electrode.

A gate signal swings between a gate-on voltage and a gate-off voltage. The gate-on voltage is set to a voltage higher than a threshold voltage of a transistor, and the gate-off voltage is set to a voltage lower than the threshold voltage of the transistor. A transistor is turned on in response to a gate-on voltage and is turned off in response to a gate-off voltage. In the case of an n-channel transistor, a gate-on voltage may be a gate high voltage VGH, and a gate-off voltage may be a gate low voltage VGL. In the case of a p-channel transistor, a gate-on voltage may be the gate low voltage VGL, and a gate-off voltage may be the gate high voltage VGH.

Hereinafter, various embodiments of the present disclosure will be described in detail with reference to the accompanying drawings.

Figure 2:
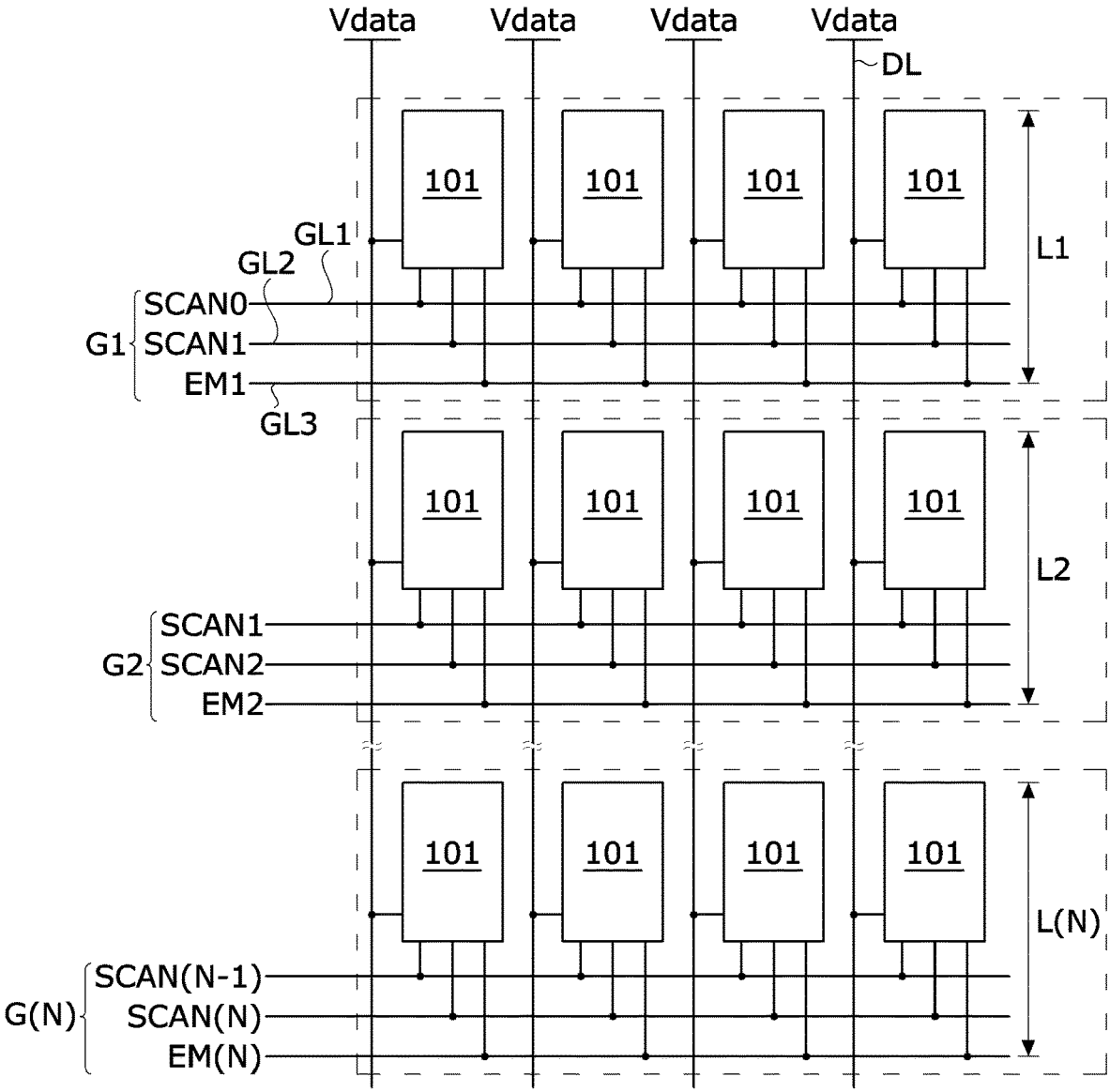
FIG. 2 is a schematic diagram illustrating some pixels and lines of a pixel array.

FIG. 1 is a block diagram illustrating a display device according to an embodiment of the present disclosure. FIG. 2 is a schematic diagram illustrating some pixels and lines of a pixel array. In FIG. 2, power lines are omitted.

Referring to FIGS. 1 and 2, the display device according to the embodiment of the present disclosure includes a display panel 100 and a display panel driver for writing pixel data of an input image to pixels of the display panel 100.

The display panel 100 includes the pixel array that displays an input image on a screen. The pixel array includes a plurality of data lines DL, a plurality of gate lines GL overlapping the data lines DL, and the pixels disposed in a matrix form defined by the data lines DL and the gate lines GL.

Each of the pixels may be divided into red, green, and blue subpixels 101 so as to represent colors. Each of the pixels may further include a white subpixel. Each of the subpixels 101 includes a pixel circuit that drives a light-emitting element OLED. In addition, the subpixels 101 may include color filters, but in the case of a mobile device, the color filters may be omitted. Hereinafter, a pixel may be interpreted as having the same meaning as a subpixel.

The pixel array includes a plurality of pixel lines L1 to Ln. The pixel line includes pixels disposed on one line disposed in a row line direction (e.g., X-axis direction). When the pixel array has a resolution of m×n, the pixel array includes n pixel lines L1 to Ln. The pixels disposed on one pixel line share the gate line and are connected to different data lines DL. The subpixels 101 disposed vertically in a column direction (e.g., Y-axis direction) share the same data line.

Touch sensors may be disposed on the screen of the display panel 100. The touch sensors may be disposed as an on-cell type or an add-on type on the screen of the display panel 100 or may be implemented as in-cell type touch sensors embedded in the pixel array.

The display panel driver writes pixel data of an input image to the subpixels 101 to reproduce the input image on the screen of the display panel 100. The display panel driver includes a data driver 110, a gate driver 120, and a timing controller 130. The display panel driver may further include a demultiplexer 112 disposed between the data driver 110 and the data lines DL.

The display panel driver may operate in a low speed driving mode. In the low speed driving mode, when an input image is analyzed and thus is not changed for a preset time, the power consumption of the display device may be reduced. In the low speed driving mode, when a still image is input for a predetermined (or selected) time or more, a refresh rate of the pixels is lowered to control a data write period of the pixels to be longer, thereby reducing power consumption. The low speed driving mode is not limited to the case of the still image being input. For example, when the display device operates in a standby mode or when a user command or an input image is not input to the display panel driver for a predetermined (or selected) time or more, the display panel driver may operate in a low speed driving mode.

The data driver 110 generates a data voltage Vdata by converting pixel data of an input image, which is digital data, into a gamma compensation voltage using a digital-to-analog converter (hereinafter, referred to as "DAC"). The gamma compensation voltage is input to the DAC by being output from a voltage divider circuit that divides a gamma reference voltage GMA to generate a voltage for each gradation. The data voltage Vdata may be supplied to the data lines DL of the display panel 100 through the demultiplexer 112.

When driving elements of the pixel circuit are implemented as p-channel transistors, a white gradation voltage is a minimum voltage in a voltage range of pixel data output from the data driver 110. For example, a white gradation voltage of pixel data may be set to 0 V and a black gradation voltage thereof may be set to 5 V, but the present disclosure is not limited thereto.

The demultiplexer 112 time-divides the data voltage Vdata output through one channel of the data driver 110 to distribute the time-divided data voltages Vdata to the plurality of data lines DL. The number of channels of the data driver 110 may be reduced due to the demultiplexer 112.

The gate driver 120 may be implemented as a gate-in panel (GIP) circuit formed directly on a bezel area BZ of the display panel 100 together with a TFT array of the pixel array. The gate driver 120 outputs gate signals to the gate lines GL under control of the timing controller 130. The gate driver 120 may shift gate signals G1 to G(N) using a shift register to sequentially supply the signals to the gate lines GL. The gate signals G1 includes scan signals SCAN0 and SCAN1 and an EM signal (emitting signal) EM1, the gate signals G2 includes scan signals SCAN1 and SCAN2 and an EM signal EM2, . . . , and the gate signals G(N) includes scan signals SCAN(N−1) and SCAN(N) and an EM signal EM(N). N is a positive integer which is greater than or equal to 1. The gate signals G1 to G(N) have a voltage that swings between a gate-off voltage VGH and a gate-on voltage VGL.

The gate driver 120 may include a first gate driver 121 and a second gate driver 122. The first gate driver 121 outputs the scan signals SCAN(N−1) and SCAN(N) and sequentially shifts the scan signals SCAN1 and SCAN2 according to a shift clock. The second gate driver 122 outputs EM signals and sequentially shifts the EM signals according to a shift clock. In the case of a model without a bezel, at least some of switch elements constituting the first and second gate drivers 121 and 122 may be distributed and disposed in the pixel array.

A gate signal including one or more scan signals and an EM signal may be applied to the pixel circuits. As shown in FIG. 2, two scan signals and one EM signal may be applied to the pixel circuits. In FIG. 2, each of the pixel lines L1, L2, and L3 is connected to three gate lines GL1, GL2, and GL3. A first pixel line L1 receives a first gate signal G1 including the scan signals SCAN0 and SCAN1 and the EM signal EM1 through the gate lines GL1, GL2, and GL3. A second pixel line L2 receives a second gate signal G2 including the scan signals SCAN1 and SCAN2 and the EM signal EM2 through the gate lines GL1, GL2, and GL3. An $N^{th}$ pixel line L(N) receives an $N^{th}$ gate signal G(N) including the scan signals SCAN(N−1) and SCAN(N) and the EM signal EM(N) through the gate lines GL1, GL2, and GL3 (wherein N is a positive integer).

The timing controller 130 receives pixel data of an input image from a host system and a timing signal synchronized with the pixel data. The timing signal includes a vertical synchronization signal Vsync, a horizontal synchronization signal Hsync, a clock signal CLK, and a data enable signal DE. One period of the vertical synchronization signal Vsync is one frame period. One period of the horizontal synchronization signal Hsync and the data enable signal DE is one horizontal period 1H. A pulse of the data enable signal DE is synchronized with one line data to be written to the pixels of one pixel line. Since a frame period and a horizontal period may be known through a method of counting the data enable signal DE, the vertical synchronization signal Vsync and the horizontal synchronization signal Hsync may be omitted.

The host system may be a main circuit board of a television (TV) system, a set top box, a navigation system, a personal computer (PC), a vehicle system, a home theater system, a mobile device, or a wearable device. In the mobile device and the wearable device, the timing controller 130, display panel drivers 110, 112, and 120, and a power source 150 may be integrated into one drive integrated circuit (IC).

The timing controller 130 may control an operation timing of the display panel drivers 110, 112, and 120 at a frame frequency of input frame frequency×i Hz obtained by multiplying an input frame frequency by i (wherein i is a positive integer greater than zero). The input frame frequency is 60 Hz in a National Television Standard Committee (NTSC) standard and 50 Hz in Phase Alternating Line (PAL) standard. The timing controller 130 may lower a frame frequency to a frequency between 1 Hz and 30 Hz in order to lower a refresh rate of pixels in a low speed driving mode.

The timing controller 130 generates a data timing control signal for controlling an operation timing of the data driver 110, a MUX signal for controlling an operation timing of the demultiplexer 112, and a gate timing control signal for controlling an operation timing of the gate driver 120 based on the timing signals Vsync, Hsync, and DE received from the host system. A voltage level of the gate timing control signal output from the timing controller 130 may be converted into the gate-off voltage VGH and the gate-on voltage VGL through a level shifter which is omitted in the drawing so that the gate-off voltage VGH and the gate-on voltage VGL may be supplied to the gate driver 120. The level shifter converts a low level voltage of the gate timing control signal into the gate-on voltage VGL and converts a high level voltage of the gate timing control signal into the gate-off voltage VGH.

The power source 150 may include a charge pump, a regulator, a buck converter, a boost converter, and the like. The power source 150 generates power required for driving the display panel driver and the display panel 100 by adjusting a direct current (DC) input voltage from the host system. The power source 150 may output DC powers such as the gamma reference voltage GMA, the gate-off voltage VGH, the gate-on voltage VGL, a pixel driving voltage VDD, a low potential power voltage VSS, an initialization voltage Vini, and a reference voltage Vref. The gamma reference voltage GMA is supplied to the data driver 110. The gate-off voltage VGH and the gate-on voltage VGL are supplied to the gate driver 120. The pixel driving voltage VDD, the low potential power voltage VSS, the initialization voltage Vini, and the reference voltage Vref are commonly supplied to the pixel circuits through the power lines omitted in FIG. 2. The pixel driving voltage VDD is set to a voltage higher than the low potential power voltage VSS, the initialization voltage Vini, and the reference voltage Vref.

Figure 3:
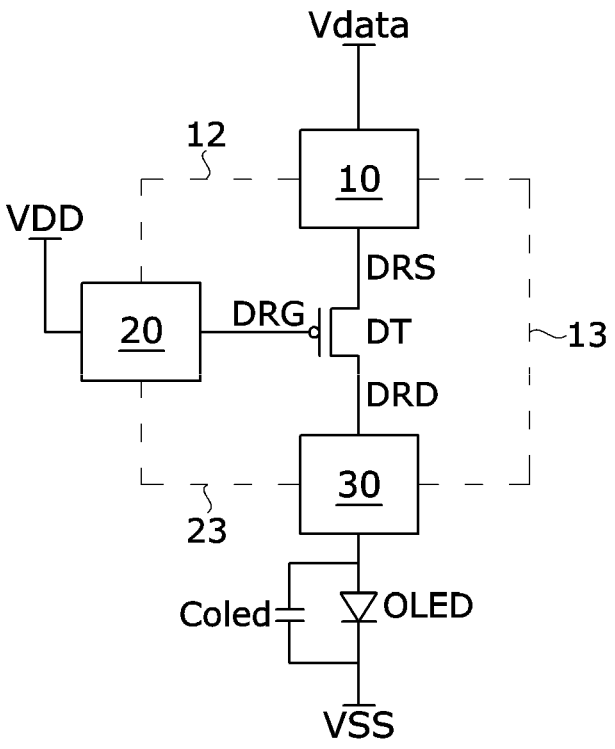
FIG. 3 is a schematic diagram illustrating a pixel circuit of the present disclosure.

FIG. 3 is a schematic diagram illustrating a pixel circuit of the present disclosure. Referring to FIG. 3, the pixel circuit may include first to third circuit units 10, 20, and 30 and first to third connection parts 12, 23, and 13. In the pixel circuit, one or more components may be omitted or added, and an internal compensation circuit may be included.

The first circuit unit 10 supplies a data voltage Vdata to a driving element DT. The driving element DT may be implemented as a transistor including a gate DRG, a source DRS, and a drain DRD. The second circuit unit 20 receives a pixel driving voltage VDD, charges a capacitor connected to the gate DRG of the driving element DT, and maintains a voltage of the capacitor during one frame period. The third circuit unit 30 supplies a current flowing from the driving element DT to a light-emitting element OLED. The light-emitting element OLED converts the current into light. The first connection part 12 connects the first circuit unit 10 and the second circuit unit 20. The second connection part 23 connects the second circuit unit 20 and the third circuit unit 30. The third connection part 13 connects the third circuit unit 30 and the first circuit unit 10.

The internal compensation circuit may include the first to third circuit units 10, 20, and 30. The internal compensation circuit samples a threshold voltage Vth of the driving element DT and supplies a current compensated for by as much as the threshold voltage Vth to the light-emitting element OLED.

Figure 4:
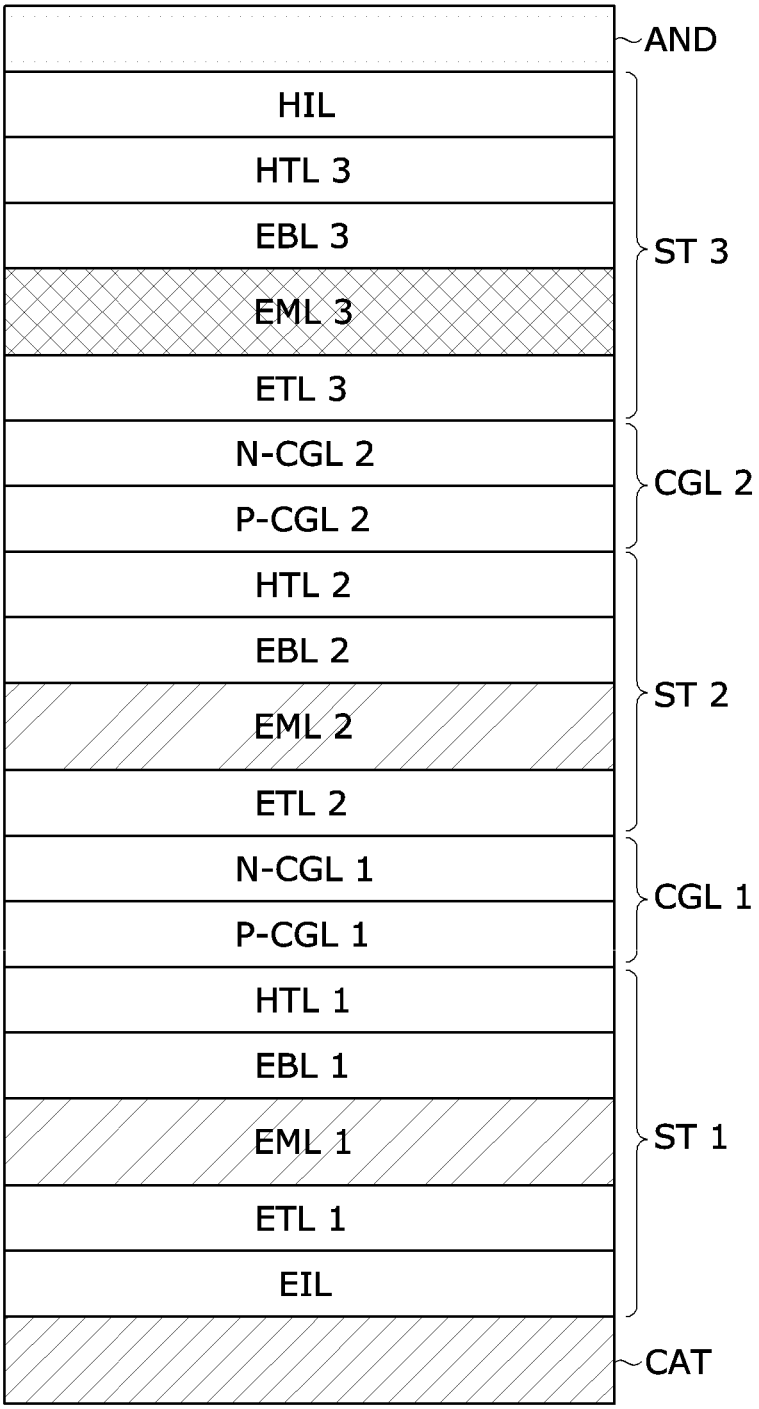
FIG. 4 is a cross-sectional view illustrating an example of a light-emitting element having a tandem structure.

In order to increase the efficiency of the light-emitting element OLED, the light-emitting element OLED may be implemented in a tandem structure. FIG. 4 illustrates an example of a three-stack tandem structure, but it should be noted that the present disclosure is not limited thereto. For example, a two-stack tandem structure is also possible.

Referring to FIG. 4, an organic compound of a light-emitting element OLED includes first to third stacks ST1, ST2, and ST3 stacked between a cathode CAT and an anode AND. The first stack ST1 includes a first emission layer EML1. The second stack ST2 includes a second emission layer EML2. The third stack ST3 includes a third emission layer EML3. The organic compound further includes a first charge generation layer CGL1 disposed between the first stack ST1 and the second stack ST2 and a second charge generation layer CGL2 disposed between the second stack ST2 and the third stack ST3.

The first charge generation layer CGL1 includes a first n-type charge generation layer N-CGL1 and a first p-type charge generation layer P-CGL1. The first n-type charge generation layer N-CGL1 is in contact with a second electron transport layer ETL2, and the first p-type charge generation layer P-CGL1 is disposed between the first n-type charge generation layer N-CGL1 and a first hole transport layers HTL1.

The second charge generation layer CGL2 includes a second n-type charge generation layer N-CGL2 and a second p-type charge generation layer P-CGL2. The second n-type charge generation layer N-CGL2 is in contact with a third electron transport layer ETL3, and the second p-type charge generation layer P-CGL2 is disposed between the second n-type charge generation layer N-CGL2 and a second hole transport layer HTL2.

Each of the first and second charge generation layers CGL1 and CGL2 may be provided as a plurality of layers including the first or second n-type charge generation layer N-CGL1 or N-CGL2 and the first or second p-type charge generation layer P-CGL1 or P-CGL2 may be provided as a single layer.

The first n-type charge generation layer N-CGL1 injects electrons into the second stack ST2, and the second n-type charge generation layer N-CGL2 injects electrons into the third stack ST3. Each of the first n-type charge generation layer N-CGL1 and the second n-type charge generation layer N-CGL2 may include an n-type dopant material and an n-type host material. The n-type dopant material may be one selected from among metals in Group I and Group II of the Periodic Table, organic materials to which electrons can be injected, or mixtures thereof. For example, the n-type dopant material may be any one selected from among alkali metals and alkali earth metals. Each of the first n-type charge generation layer N-CGL1 and the second n-type charge generation layer N-CGL2 may be formed as an organic layer doped with an alkali metal such as lithium (Li), sodium (Na), potassium (K), or cesium (Cs), or an alkaline earth metal such as magnesium (Mg), strontium (Sr), barium (Ba), or radium (Ra), but the present disclosure is not limited thereto. The n-type host material may include a material capable of transferring electrons, for example, at least one selected from among tris(8-hydroxyquinolino)aluminum ($Alq_3$), 8-hydroxyquinolinolato-lithium (Liq), 2-(4-biphenylyl)-5-(4-tert-butylphenyl)-1,3,4-oxadiazole (PBD), 3-(4-biphenyl)4-phenyl-5-tert-butylphenyl-1,2,4-triazole (TAZ), spiro-PBD, bis(2-methyl-8-quinolinolate)-4-(phenylphenolato) aluminum (BAlq), SAlq, 2,2,2-(1,3,5-benzinetriyl)-tris(1-phenyl-1-H-benzimidazole) (TPBi), oxadiazole, triazole, phenanthroline, benzoxazole, and benzthiazole, but the present disclosure is not limited thereto.

The first p-type charge generation layer P-CGL1 injects holes into the first stack ST1, and the second p-type charge generation layer P-CGL2 injects holes into the second stack ST2. Each of the first p-type charge generation layer P-CGL1 and the second p-type charge generation layer P-CGL2 may include a p-type dopant material and a p-type host material. The p-type dopant material may include a metal oxide, an organic material such as tetrafluoro-tetracyanoquinodimethane (F4-TCNQ), hexaazatriphenylene-hexacarbonitrile (HAT-CN), or hexaazatriphenylene, or a metal material such as $V_2O_5$, $MoO_x$, or $WO_3$, but the present disclosure is not limited thereto. The p-type host material may include a material capable of transferring, for example, at least one selected from among (N,N'-bis(naphthalene-1-yl)-N,N'-bis(phenyl)-2,2'-dimethylbenzidine) (NPD), N,N'-bis-(3-methylphenyl)-N,N'-bis-(phenyl)-benzidine (TPD), and 4,4',4-Tris(N-3-methylphenyl-N-phenyl-amino)-triphenylamine (MTDATA), but the present disclosure is not limited thereto.

The first stack ST1 may include an electron injection layer EIL, a first electron transport layer ETL1, the first emission layer EML1, a first electron blocking layer EBL1, and the first hole transport layer HTL1. The second stack ST2 may include the second electron transport layer ETL2, the second emission layer EML2, a second electron blocking layer EBL2, and the second hole transport layer HTL2. The third stack ST3 may include the third electron transport layer ETL3, the third emission layer EML3, a third electron blocking layer EBL3, a third hole transport layer HTL3, and a hole injection layer HIL.

The hole injection layer HIL facilitates the injection of holes from the anode AND to the third emission layer EML3. The hole injection layer HIL may include, for example, at least one selected from among dipyrazino[2,3-f:2',3'-h]quinoxaline-2,3,6,7,10.11-hexacarbonitrile (HAT-CN), phthalocyanine (CuPc), 2,3,5,6-tetrafluoro-7,7,8,8-tetracyanoquinodimethane (F4-TCNQ), and N,N'-bis (naphthalene-1-yl)-N,N'-bis(phenyl)-2,2'-dimethylbenzidine (NPD), but the present disclosure is not limited thereto.

The first to third hole transport layers HTL1, HTL2, and HTL3 smoothly transfer holes to the first to third emission layers EML1, EML2, and EML3, respectively. Each of the first to third hole transport layers HTL1, HTL2, and HTL3 may include, for example, at least one selected from among NPD, TPD, 2,2',7,7'-tetrakis(N,N-dimethylamino)-9,9-spirofluorene (s-TAD), and MTDATA, but the present disclosure is not limited thereto.

The first to third electron blocking layers EBL1, EBL2, and EBL3 prevent electrons injected into the first to third emission layers EML1, EML2, and EML3 from flowing to the first to third hole transport layers HTL1, HTL2, and HTL3, respectively. The first to third electron blocking layers EBL1, EBL2, and EBL3 block the movement of electrons to improve the combination between holes and electrons in the first to third emission layers EML1, EML2, and EML3 and improve the luminous efficiency of the first to third emission layers EML1, EML2, and EML3. Each of the first to third electron blocking layers EBL1, EBL2, and EBL3 may be made of the same material as each of the first to third hole transport layers HTL1, HTL2, and HTL3, and each of the first to third hole transport layers HTL1, HTL2, and HTL3 and the first to third electron blocking layers EBL1, EBL2, and EBL3 may be formed as a separate layer, but the present disclosure is not limited thereto. For example, the first to third hole transport layers HTL1, HTL2, and HTL3 may be integrated with the first to third electron blocking layers EBL1, EBL2, and EBL3, respectively.

Holes and electrons are recombined in the first to third emission layers EML1, EML2, and EML3 to generate excitons. The first to third emission layers EML1, EML2, and EML3 are respectively disposed between the first to third hole transport layers HTL1, HTL2, and HTL3 and the first to third electron transport layers ETL1, ETL2, and ETL3 and each include a material capable of emitting specific color light. For example, the first emission layer EML1 may include a material capable of emitting green light, and the second emission layer EML2 may include a material capable of emitting blue light. The third organic emission layer EML3 may include a material capable of emitting red light.

Each of the emission layers EML1, EML2, and EML3 may include a host-dopant system, that is, a small amount of a light-emitting dopant material added into a host material occupying a large weight ratio. Each of the emission layers EML1, EML2, and EML3 may include a plurality of host materials or may include a single host material.

The first emission layer EML1 may include a green phosphorescent dopant material with which a host material is doped. The first emission layer EML1 may be a green emission layer, and a wavelength of light emitted from the first emission layer EML1 may range from 490 nm to 570 nm. The first emission layer EML1 may include a host material including carbazole biphenyl (CBP) or 1,3-bis (carbazol-9-yl (mCP) and may include a phosphorescent material including a dopant material which includes Ir(ppy) 3(fac tris(2-phenylpyridine)iridium), Ir(ppy)2(acac), or Ir(mpyp)3, but the present disclosure is not limited thereto.

The second emission layer EML2 may include a blue fluorescent dopant material with which a host material is doped. The second emission layer EML2 may be a blue emission layer, and a wavelength of light emitted from the second emission layer EML2 may range from 490 nm to 450 nm. The second emission layer EML2 may include a host material including CBP or mCP and may include a fluorescent material including any one selected from the group consisting of spiro-DPVBi, spiro-6P, distyrylbenzene (DSB), distyrylarylene (DSA), a PFO-based polymer, and a PPV-based polymer, but the present disclosure is not limited thereto.

The third emission layer EML3 may include a red phosphorescent dopant material with which a host material is doped. The third emission layer EML3 may be a red emission layer, and a wavelength of light emitted from the third emission layer EML3 may range from 720 nm to 640 nm. The third emission layer EML3 may include a host material including CBP or mCP and may include a phosphorescent dopant including at least one selected from among PIQIr(acac)(bis(1-phenylisoquinoline)acetylacetonate iridium), PQIr(acac)(bis(1-phenylquinoline)acetylacetonate iridium), BtP2Ir(acac), PQIr(tris(1-phenylquinoline) iridium), and PtOEP(octaethylporphyrin platinum).

The first to third electron transport layers ETL1, ETL2, and ETL3 transfer electrons from the electron injection layer EIL, the first n-type charge generation layer N-CGL1, and the second n-type charge generation layer N-CGL2 to the emission layers EML, respectively. The first to third electron transport layers ETL1, ETL2, and ETL3 may serve as a hole blocking layer (HBL). The HBL may prevent the leakage of holes that did not participate in recombination in the emission layer EML.

The first to third electron transport layers ETL1, ETL2, and ETL3 may include, for example, at least one selected from Liq, PBD, TAZ, 2,9-dimethyl-4,7-diphenyl-1,10-phenanthroline (BCP), and BAlq, but the present disclosure is not limited thereto.

The electron injection layer EIL facilitates the injection of electrons into the first emission layer EML1. The electron injection layer EIL may include, for example, at least one selected from among alkali metal or alkaline earth metal ion forms such as LiF, $BaF_2$, and CsF, but the present disclosure is not limited thereto.

Figure 5:
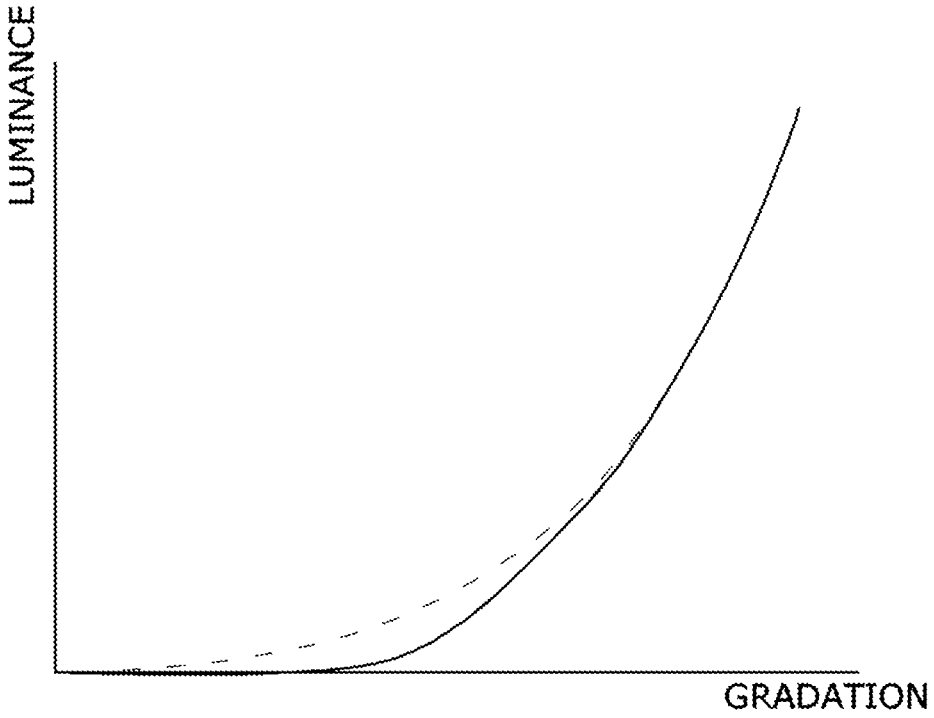
FIG. 5 is a graph showing an example in which luminance at a low gradation is decreased in a light-emitting element having improved efficiency.

Since the light-emitting element OLED having a tandem structure can emit light with high luminance at a low current, efficiency can be improved. Since capacitance of a capacitor Coled of the light-emitting element OLED is increased, a charging time of the capacitor Coled may be delayed at a low current. As shown in FIG. 5, expression characteristics may be degraded at a low gradation, and a flicker may be caused in a low speed driving mode. FIG. 5 is a graph showing an example in which luminance of a light-emitting element is decreased at a low gradation (solid line). In FIG. 5, a dotted line indicates an ideal gamma curve.

Figure 6:
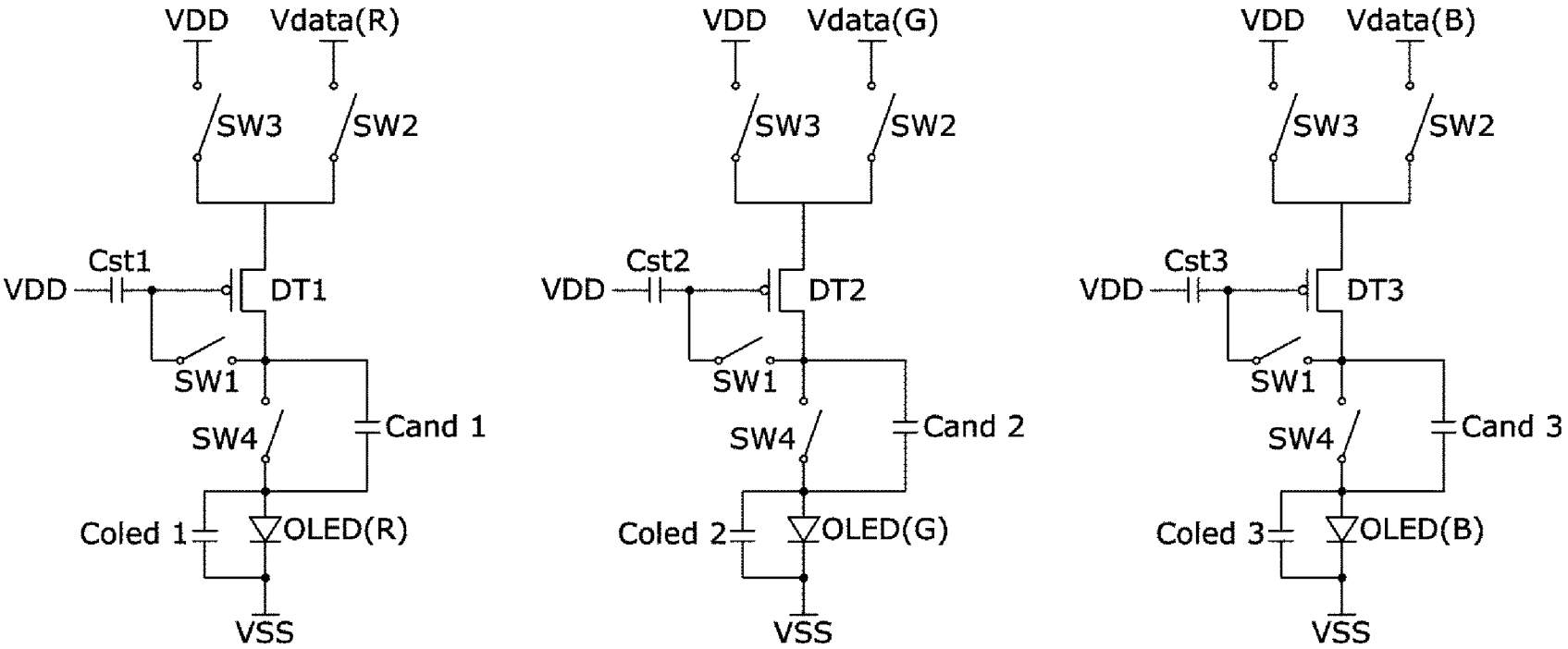
FIG. 6 shows circuit diagrams illustrating pixel circuits according to a first embodiment of the present disclosure.
Figure 7:
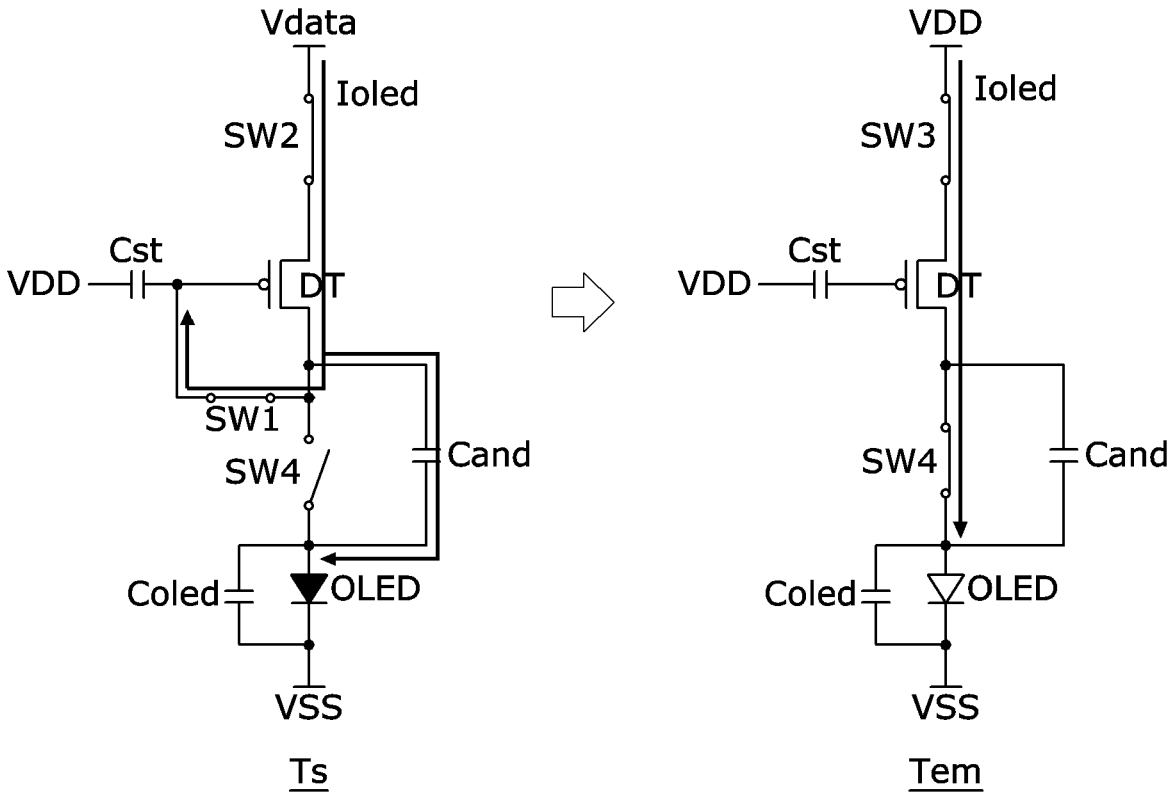
FIG. 7 shows circuit diagrams illustrating a driving method of the pixel circuit shown in FIG. 6.

FIG. 6 shows circuit diagrams illustrating pixel circuits according to a first embodiment of the present disclosure. FIG. 7 shows circuit diagrams illustrating a driving method of the pixel circuit shown in FIG. 6.

Referring to FIGS. 6 and 7, a red subpixel includes a first driving element DT1, a first light-emitting element OLED (R), first to fourth switch elements SW1 to SW4, a first capacitor Cst1 connected to a gate electrode of the first driving element DT1, a second capacitor Cand1 connected between the first electrode of the first driving element DT1 and an anode AND of the first light-emitting element OLED (R), and a third capacitor Coled1 connected between the anode AND and a cathode CAT of the first light-emitting element OLED(R).

A green subpixel includes a second driving element DT2, a second light-emitting element OLED(G), first to fourth switch elements SW1 to SW4, a first capacitor Cst2 connected to a gate electrode of the second driving element DT2, a second capacitor Cand2 connected between the first electrode of the second driving element DT2 and an anode AND of the second light-emitting element OLED(G), and a third capacitor Coled2 connected between the anode AND and a cathode CAT of the second light-emitting element OLED(G).

A blue subpixel includes a third driving element DT3, a third light-emitting element OLED(B), first to fourth switch elements SW1 to SW4, a first capacitor Cst3 connected to a gate electrode of the third driving element DT3, a second capacitor Cand3 connected between the first electrode of the third driving element DT3 and an anode AND of the third light-emitting element OLED(B), and a third capacitor Coled3 connected between the anode AND and a cathode CAT of the third light-emitting element OLED(B).

In FIG. 6, OLED(R) denotes the light-emitting element of the red subpixel, and Vdata(R) denotes a data voltage applied to the red subpixel. OLED(G) denotes the light-emitting element of the green subpixel, and Vdata(G) denotes a data voltage applied to the green subpixel. OLED (B) denotes the light-emitting element of the blue subpixel, and Vdata(B) denotes a data voltage applied to the blue subpixel.

In FIG. 7, OLED(R), OLED(G) and OLED(B) in FIG. 6 are generally denoted as OLED, Vdata(R), Vdata(G) and Vdata(B) in FIG. 6 are generally denoted as Vdata, DT1, DT2 and DT3 in FIG. 6 are generally denoted as DT, Cand1, Cand2 and Cand3 in FIG. 6 are generally denoted as Cand, Coled1, Coled2 and Coled3 in FIG. 6 are generally denoted as Coled, and Cst1, Cst2 and Cst3 in FIG. 6 are generally denoted as Cst.

In each of the subpixels, the first switch element SW1 is turned on in a first step to connect the gate electrode and a second electrode of the driving element DT1, DT2, or DT3 and then is turned off in a second step. As shown in FIG. 7, the first switch element SW1 may be turned on or off according to a voltage of an $N^{th}$ scan signal SCAN(N). In embodiments to be described below, the first step may include a sampling step Ts, and the second step may include an emission step Tem.

The second switch element SW2 is turned on in the first step to supply the data voltages Vdata(R), Vdata(G), or Vdata(B) to a first electrode of the driving element DT1, DT2, or DT3 and then is turned off in the second step. As shown in FIG. 7, the second switch element SW2 may be turned on or off according to the voltage of the $N^{th}$ scan signal SCAN(N).

The third switch element SW3 is in an off state in the first step and is turned on in the second step to supply a pixel driving voltage VDD to the first electrode of the driving element DT1, DT2, or DT3. As shown in FIG. 7, the third switch element SW3 may be turned on or off according to a voltage of an EM signal EM(N).

The fourth switch element SW4 is in an off state in the first step and is turned on in the second step to connect the second electrode of the driving element DT1, DT2, or DT3 to the anode of the light-emitting element OLED(R), OLED (G), or OLED(B). As shown in FIG. 7, the fourth switch element SW4 may be turned on or off according to the voltage of the EM signal EM(N).

The second capacitors Cand1, Cand2, and Cand3 are charged according to a current I flowing through the driving elements DT1, DT2, and DT3 in the first step to increase an anode voltage of the light-emitting elements OLED(R), OLED(G), and OLED(B). Therefore, the anodes and the third capacitors Coled1, Coled2, and Coled3 of the light-emitting elements OLED(R), OLED(G), and OLED(B) are pre-charged according to a voltage applied through a capacitor coupling in the first step. In the first step, the anodes and the third capacitors Coled1, Coled2, and Coled3 of the light-emitting elements OLED(R), OLED(G), and OLED (B) are determined according to a gradation voltage of the data voltages Vdata(R), Vdata(G), and Vdata(B) and thus are set to have an appropriate voltage according to a gradation value of pixel data.

In the first step, the light-emitting elements OLED(R), OLED(G), and OLED(B) emit light according to a current holed flowing through the driving elements DT1, DT2, and DT3. In this case, even when the current holed is low, since the capacitors Coled1, Coled2, and Coled3 of the light-emitting elements are pre-charged, an anode voltage is rapidly increased, thereby improving an ability to express a low gradation.

A capacitance of the second capacitor Cand1, Cand2, or Cand3 may be determined in a range between a maximum of 1:1 and a minimum of 10:1 with respect to that of the first capacitor Cst1, Cst2, or Cst3. The capacitance of the second capacitor Cand1, Cand2, or Cand3 may be determined in a range between a maximum of 1:1 and a minimum of 10:1 with respect to that of the third capacitor Coled1, Coled2, or Coled2. In other words, the capacitance of the second capacitor Cand1 may be determined in a range that is less than or equal to the capacitance of the first capacitor Cst1 and is greater than or equal to 1/10 of the capacitance of the first capacitor Cst1, the capacitance of the second capacitor Cand2 may be determined in a range that is less than or equal to the capacitance of the first capacitor Cst2 and is greater than or equal to 1/10 of the capacitance of the first capacitor Cst2, and the capacitance of the second capacitor Cand3 may be determined in a range that is less than or equal to the capacitance of the first capacitor Cst3 and is greater than or equal to 1/10 of the capacitance of the first capacitor Cst3. In addition, the capacitance of the second capacitor Cand1 may be determined in a range that is less than or equal to the capacitance of the third capacitor Coled1 and is greater than or equal to 1/10 of the capacitance of the third capacitor Coled1, the capacitance of the second capacitor Cand2 may be determined in a range that is less than or equal to the capacitance of the third capacitor Coled2 and is greater than or equal to 1/10 of the capacitance of the third capacitor Coled2, and the capacitance of the second capacitor Cand3 may be determined in a range that is less than or equal to the capacitance of the third capacitor Coled3 and is greater than or equal to 1/10 of the capacitance of the third capacitor Coled3.

There may be a parasitic capacitance between the driving elements DT1, DT2, and DT3 and the light-emitting elements OLED(R), OLED(G), and OLED(B), but since the parasitic capacitance is less than 1 Ff, the capacitance of the second capacitor Cand1, Cand2, or Cand3 is much greater than the parasitic capacity.

The second capacitors Cand1, Cand2, and Cand3 may be formed on a display panel 100 with the same cross-sectional structure as the storage capacitors Cst1, Cst2, and Cst3. The capacitances of the second capacitors Cand1, Cand2, and Cand3 may be set differently according to colors of the subpixels. For example, it can be determined that the magnitude of the capacitance of the second capacitors Cand3 of the blue subpixel >the magnitude of the capacitance of the second capacitors Cand1 of the red subpixel >the magnitude of the capacitance of the second capacitors Cand2 of the green subpixel.

The capacitances of the third capacitors Coled1, Coled2, and Coled3 according to the colors of the subpixels may vary according to the thickness and aperture ratio of organic compounds of the light-emitting elements. Accordingly, the capacitances of the capacitors Cand1, Cand2, and Cand3 may be determined according to the capacitors Coled1, Coled2, and Coled3 of the third light-emitting element.

Figure 8:
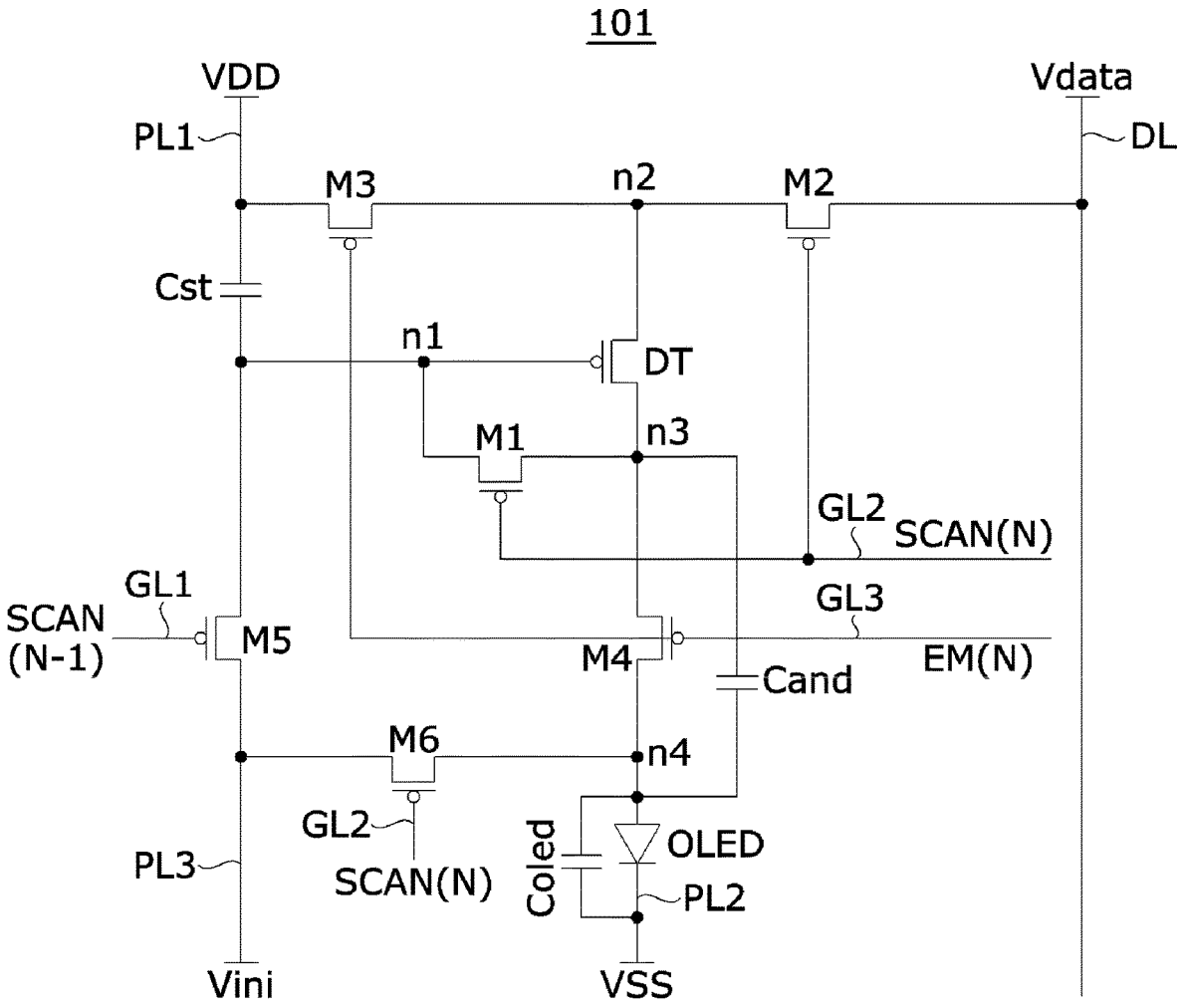
FIG. 8 is a circuit diagram illustrating a pixel circuit according to a second embodiment of the present disclosure.

FIG. 8 is a circuit diagram illustrating a pixel circuit according to a second embodiment of the present disclosure.

Referring to FIG. 8, the pixel circuit includes a light-emitting element OLED, a driving element DT, a plurality of switch elements M1 to M6, a first capacitor Cst, a second capacitor Cand, and the like. The driving element DT and the switch elements M1 to M6 may be implemented as p-channel switch elements.

A pixel driving voltage VDD is supplied to the pixel circuit through a VDD line (pixel driving voltage line) PL1. A low potential power voltage VSS is supplied to the pixel circuit through a VSS line PL2. An initialization voltage Vini is supplied to the pixel circuit through a Vini line (initialization voltage line) PL3. A gate signal including an $(N-1)^{th}$ scan signal SCAN(N−1), an $N^{th}$ scan signal SCAN(N), and an EM signal EM(N) is supplied to the pixel circuit. The $(N-1)^{th}$ scan signal SCAN(N−1) is synchronized with a data voltage Vdata of an $(N-1)^{th}$ pixel line. The $N^{th}$ scan signal SCAN(N) is synchronized with the data voltage Vdata of an $N^{th}$ pixel line. A pulse of the $N^{th}$ scan signal SCAN(N) is generated to have the same pulse width as the $(N-1)^{th}$ scan signal SCAN(N−1) and is generated later than a pulse of the $(N-1)^{th}$ scan signal SCAN(N−1).

The driving element DT drives the light-emitting element OLED by controlling a current flowing in the light-emitting element OLED according to a gate-source voltage Vgs. The driving element DT includes a gate electrode connected to a first node n1, a first electrode connected to a second node n2, and a second electrode connected to a third node n3. The first node n1 is connected to the first capacitor Cst, the gate electrode of the driving element DT, and a first electrode of the first switch element M1. The second node n2 is connected to a first electrode of the second switch element M2 and a second electrode of the third switch element M3. The third node n3 is connected to the second electrode of the driving element DT, a second electrode of the first switch element M1, and a first electrode of the fourth switch element M4.

An anode AND of the light-emitting element OLED is connected to a fourth node n4, and a cathode CAT thereof is connected to the VSS line PL2 to which the low potential power voltage VSS is applied. The fourth node n4 is connected to the anode AND of the light-emitting element OLED, a second electrode of the fourth switch element M4, and a second electrode of the sixth switch element M6. The light-emitting element OLED includes a third capacitor Coled formed between the anode AND and the cathode CAT.

The first capacitor Cst is connected between the VDD line PL1 and the first node n1. The second capacitor Cand is connected between the third node n3 and the fourth node n4.

The first switch element M1 is turned on according to a gate-on voltage VGL of the $N^{th}$ scan signal SCAN(N) to connect the first node n1 and the third node n3. The first switch element M1 includes a gate electrode connected to a second gate line GL2, a first electrode connected to the first node n1, and a second electrode connected to the third node n3. The $N^{th}$ scan signal SCAN(N) is supplied to pixels P through the second gate line GL2.

Figure 12:
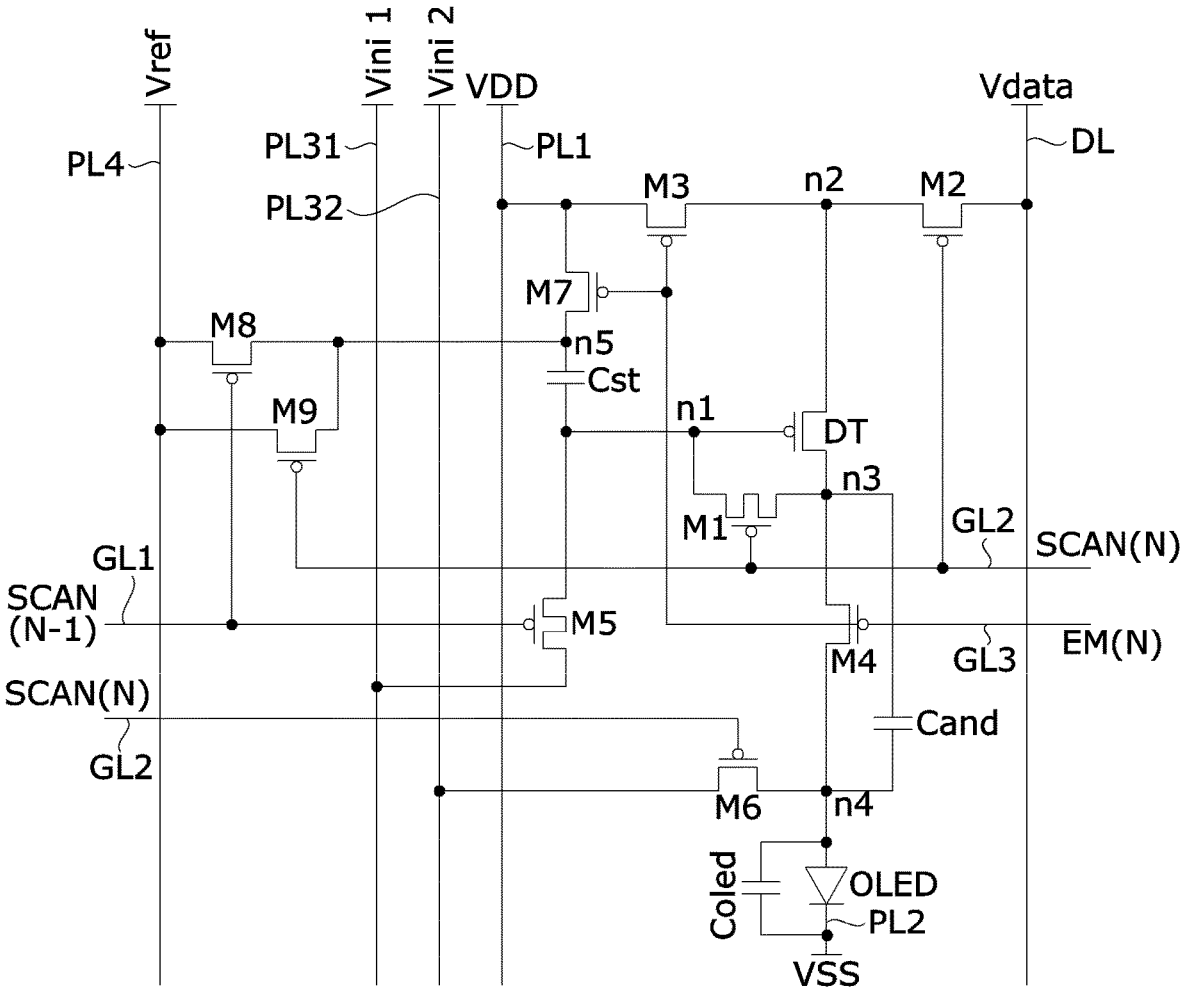
FIG. 12 is a circuit diagram illustrating a pixel circuit according to a third embodiment of the present disclosure.

In some embodiments, since the first switch element M1 is turned on only during one very short horizontal period 1H of one frame period in which the $N^{th}$ scan signal SCAN(N) is generated as the gate-on voltage VGL, the first switch element M1 maintains an off state during approximately one frame period. Thus, a leakage current may be generated in the off state of the first switch element M1. In order to suppress the leakage current of the first switch element M1, as shown in FIG. 12, the first switch element M1 may be implemented as a transistor having a dual gate structure in which two transistors are connected in series.

The second switch element M2 is turned on according to the gate-on voltage VGL of the $N^{th}$ scan signal SCAN(N) to connect a data line DL to the second node n2. The second switch element M2 includes a gate electrode connected to the second gate line GL2, a first electrode connected to the second node n2, and a second electrode connected to the data line DL.

The third switch element M3 is turned on according to the gate-on voltage VGL of the EM signal EM(N) to connect the VDD line PL1 to the first electrode of the driving element DT. The third switch element M3 includes a gate electrode connected to a third gate line GL3, a first electrode connected to the VDD line PL1, and a second electrode connected to the second node n2. The EM signal EM(N) is supplied to the pixel circuit through the third gate line GL3.

The fourth switch element M4 is turned on according to the gate-on voltage VGL of the EM signal EM(N) to connect the third node n3 to the fourth node n4. A gate electrode of the fourth switch element M4 is connected to the third gate line GL3. The first electrode of the fourth switch element M4 is connected to the third node n3, and the second electrode of the fourth switch element M4 is connected to the fourth node n4.

The fifth switch element M5 is turned on according to the gate-on voltage VGL of the $(N-1)^{th}$ scan signal SCAN(N−1) to connect the first node n1 to the Vini line PL3. The fifth switch element M5 includes a gate electrode connected to the first gate line GL1, a first electrode connected to the first node n1, and a second electrode connected to the Vini line PL3. The $(N-1)^{th}$ scan signal SCAN(N−1) is supplied to the pixel circuit through the first gate line GL1. The initialization voltage Vini is supplied to the pixel circuit through the Vini line PL3. In order to suppress a leakage current of the fifth switch element M5, as shown in FIG. 12, the fifth switch element M5 may be implemented as a transistor having a dual gate structure in which two transistors are connected in series.

The sixth switch element M6 is turned on according to the gate-on voltage VGL of the $N^{th}$ scan signal SCAN(N) to connect the Vini line PL3 to the fourth node n4. The sixth switch element M6 includes a gate electrode connected to the second gate line GL2, a first electrode connected to the Vini line PL3, and a second electrode connected to the fourth node n4.

Figure 9A:
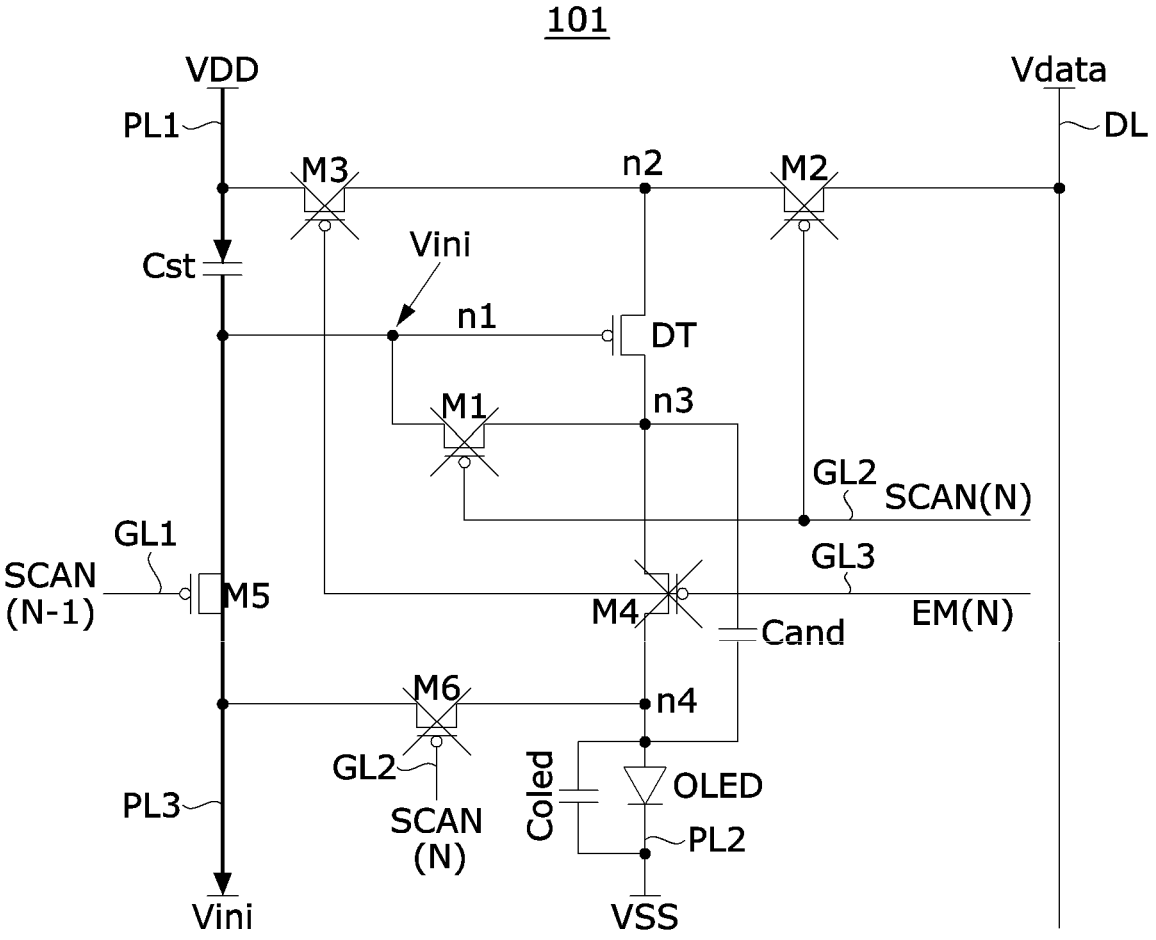
FIGS. 9A to 11B are diagrams sequentially illustrating the operation of the pixel circuit shown in FIG. 8.
Figure 9B:
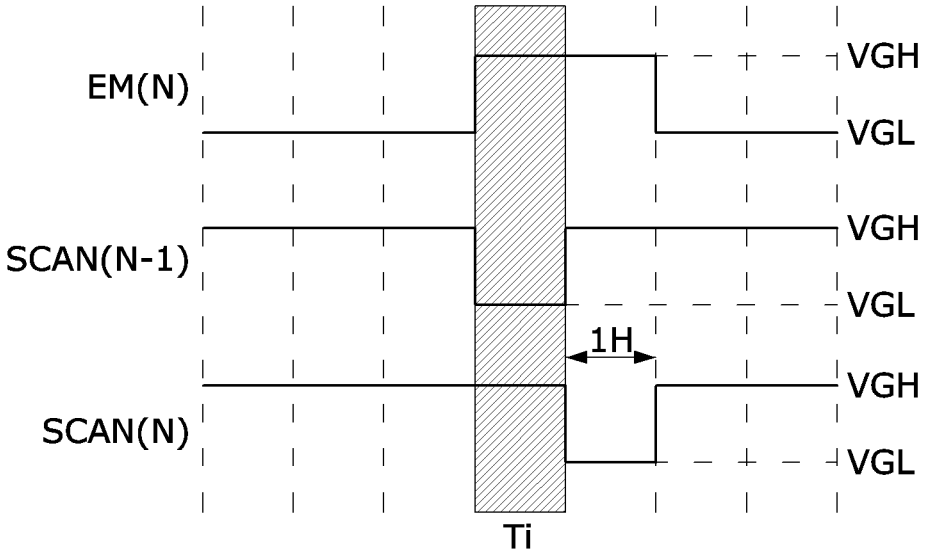
Figure 10A:
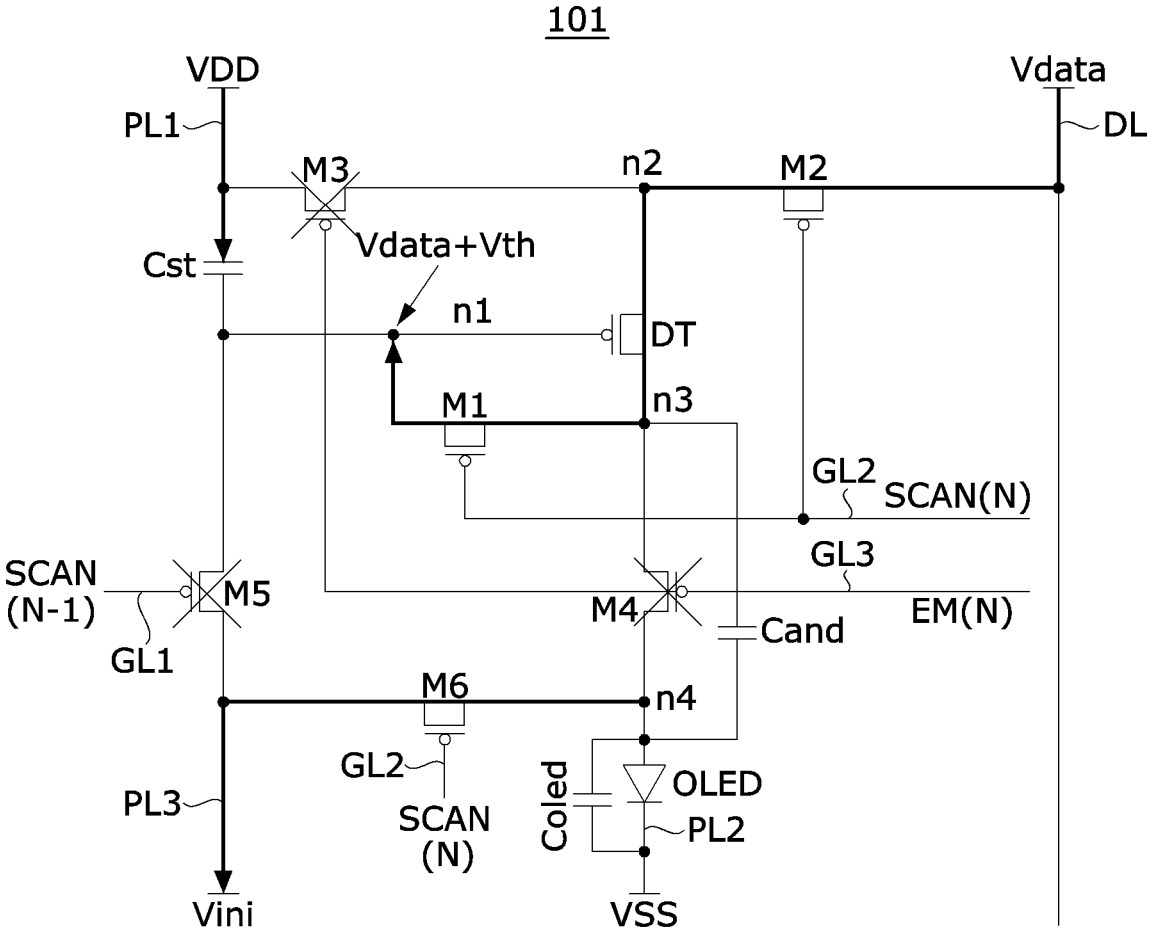
Figure 10B:
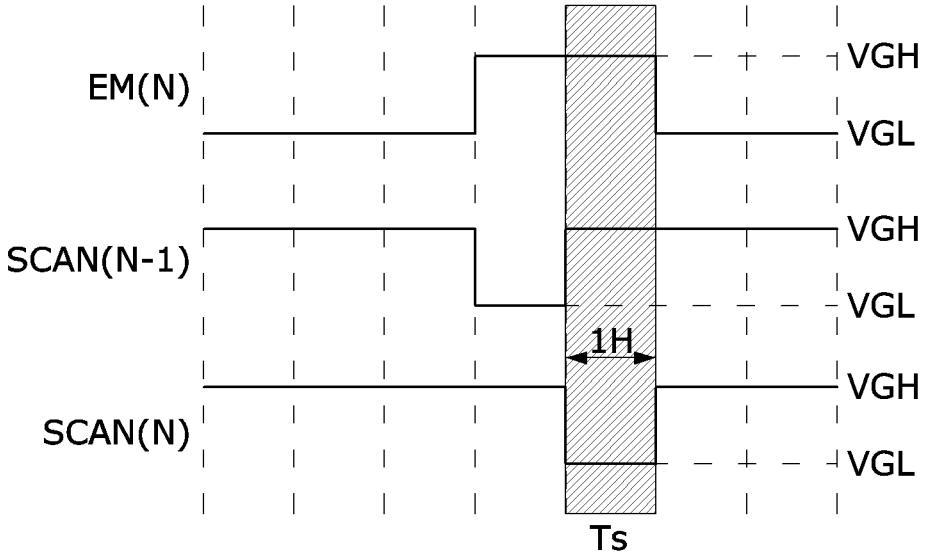
Figure 11A:
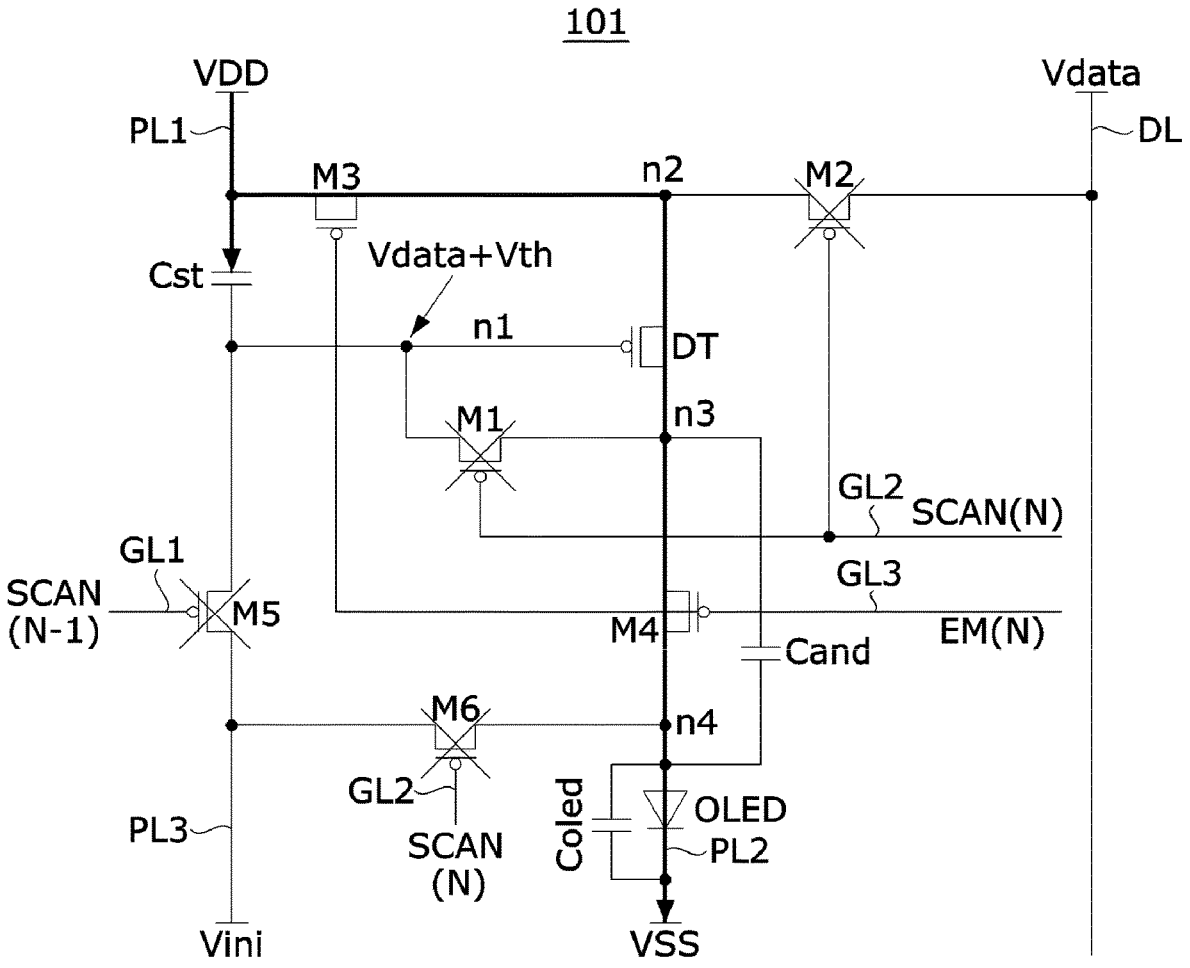
Figure 11B:
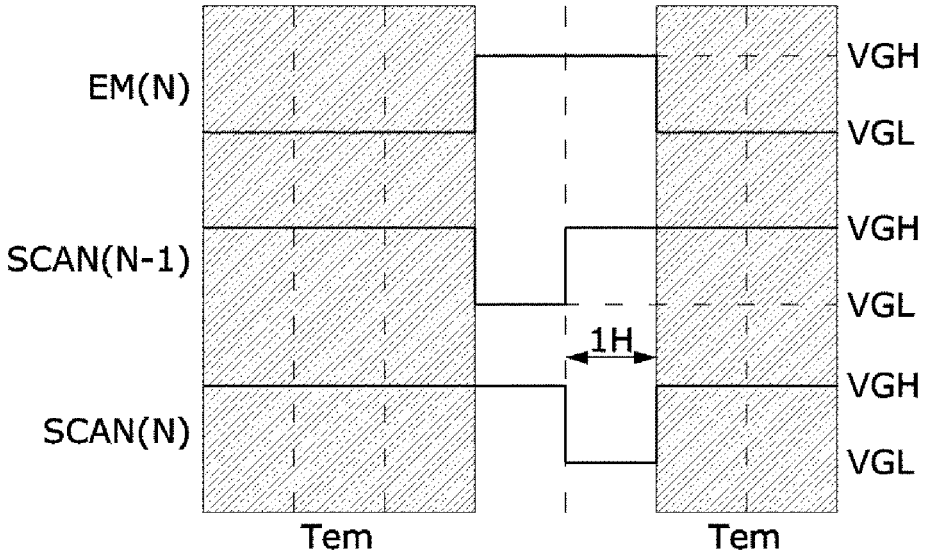

FIGS. 9A to 11B are diagrams sequentially illustrating the operation of the pixel circuit shown in FIG. 8. FIG. 9A is a circuit diagram illustrating a path of a current flowing in the pixel circuit in an initialization step Ti. FIG. 10A is a circuit diagram showing a path of a current flowing in the pixel circuit in a sampling step Ts. FIG. 11A is a circuit diagram showing a path of a current flowing in the pixel circuit in an emission step Tem. FIGS. 9B, 10B, and 11B are waveform diagrams illustrating a gate signal applied to the pixel circuit shown in FIG. 8. In FIGS. 9B, 10B, and 11B, arrows indicate a current flow in the pixel circuit.

Referring to FIGS. 9A and 9B, in the initialization step Ti, a voltage of the $(N-1)^{th}$ scan signal SCAN(N−1) is the gate-on voltage VGL. In the initialization step Ti, the $N^{th}$ scan signal SCAN(N) and the EM signal EM(N) have the gate-off voltage VGH. The fifth switch element M5 is turned on according to the gate-on voltage VGL of the $(N-1)^{th}$ scan signal SCAN(N−1) in the initialization step Ti to discharge the first node n1 to the initialization voltage Vini. In this case, the first node n1 is initialized.

Referring to FIGS. 10A and 10B, in the sampling step Ts, a voltage of the $N^{th}$ scan signal SCAN(N) is the gate-on voltage VGL. In the sampling step Ts, the $(N-1)^{th}$ scan signal SCAN(N−1) and the EM signal EM(N) have the gate-off voltage VGH. The first and second switch elements M1 and M2 are turned on in the sampling step Ts according to the gate-on voltage VGL that is the voltage of the $N^{th}$ scan signal SCAN(N). The anode of the light-emitting element OLED and the fourth node n4 are pre-charged by a voltage applied through the second capacitor Cand in the sampling step Ts. In the sampling step Ts, the data voltage Vdata is applied to the second node n2, and a voltage of the first node n1 is changed into Vdata+Vth. "Vth" denotes a threshold voltage of the driving element DT. As a result, in the sampling step Ts, the threshold voltage Vth of the driving element DT is sampled and charged in the first node n1.

Referring to FIGS. 11A and 11B, a voltage of the EM signal EM(N) in the emission step Tem is the gate-on voltage VGL. In the emission step Tem, the $(N-1)^{th}$ and $N^{th}$ scan signals SCAN(N−1) and SCAN(N) have the gate-off voltage VGH. The third and fourth switch elements M3 and M4 are turned on in the emission step Tem according to the gate-on voltage VGL that is the voltage of the EM signal EM(N). During the emission step Tem, a current may flow in the light-emitting element OLED through the driving element DT so that the light-emitting element OLED may emit light. The current flowing in the light-emitting element OLED is adjusted according to the gate-source voltage Vgs of the driving element DT. The gate-source voltage Vgs of the driving element DT is Vdata+Vth−VDD during the emission step Tem.

Figure 13:
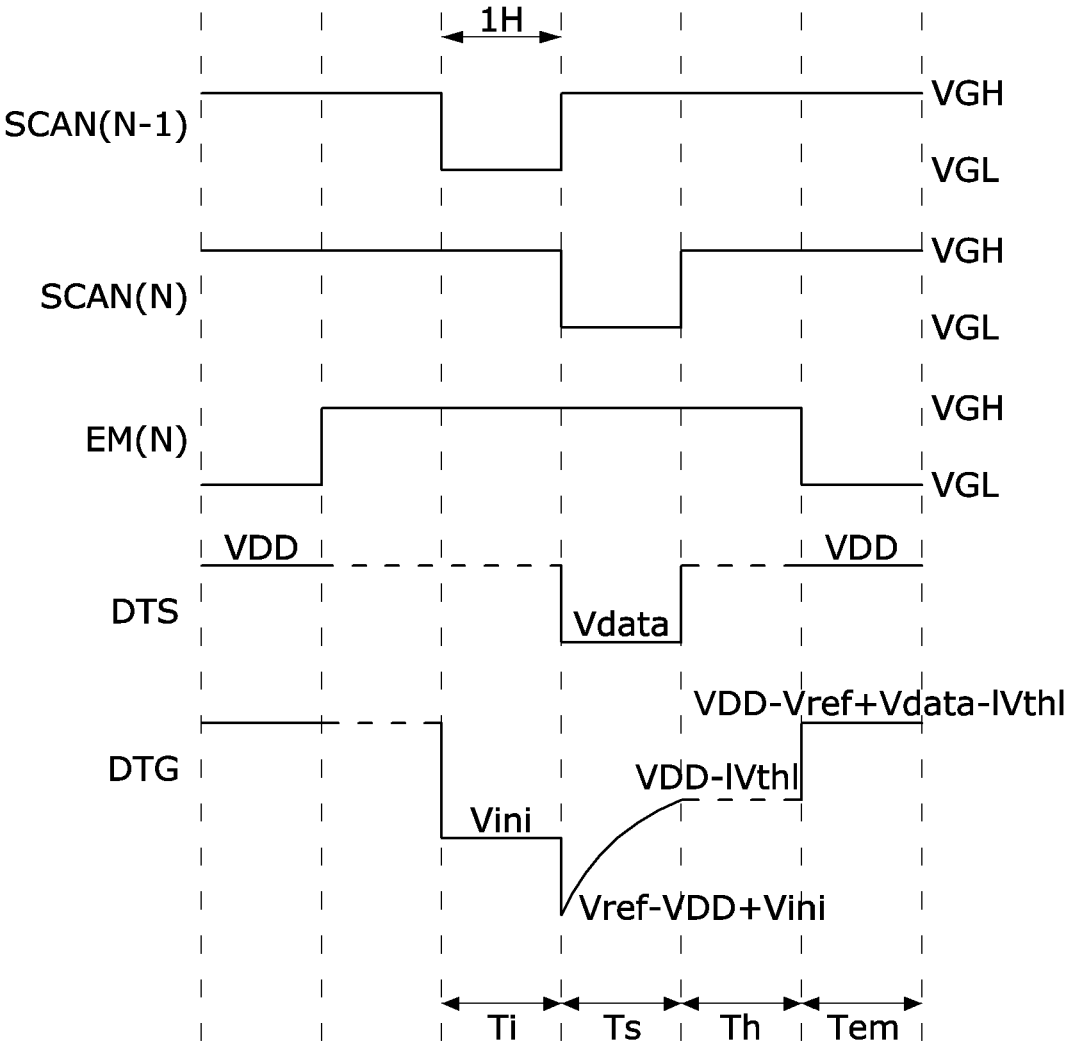
FIG. 13 is a waveform diagram illustrating a driving method of the pixel circuit shown in FIG. 12.

Meanwhile, as shown in FIG. 13, a holding step Th may be set between the sampling step Ts and the emission step Tem. In the holding step Th, all the switch elements of the pixel circuit may be turned off.

FIG. 12 is a circuit diagram illustrating a pixel circuit according to a third embodiment of the present disclosure. In FIG. 12, detailed descriptions of the same components as the above-described embodiments will be omitted.

Referring to FIG. 12, the pixel circuit includes a light-emitting element OLED, a driving element DT, a plurality of switch elements M1 to M9, a first capacitor Cst, a second capacitor Cand, and the like. The driving element DT and the switch elements M1 to M9 may be implemented as p-channel switch elements.

An initialization voltage Vini may be divided into a first initialization voltage Vini1 for initializing the driving element DT and a second initialization voltage Vini2 for initializing the light-emitting element OLED. The first and second initialization voltages Vini1 and Vini2 may be set to be the same or different voltages. The initialization voltage Vini1 is supplied to the pixel circuit through the Vini line PL31, and the initialization voltage Vini2 is supplied to the pixel circuit through the Vini line PL32.

The driving element DT drives the light-emitting element OLED by controlling a current flowing in the light-emitting element OLED according to a gate-source voltage Vgs. The driving element DT includes a gate electrode connected to a first node n1, a first electrode connected to a second node n2, and a second electrode connected to a third node n3.

An anode AND of the light-emitting element OLED is connected to a fourth node n4, and a cathode CAT thereof is connected to a VSS line PL2 to which a low potential power voltage VSS is applied. The light-emitting element OLED includes a third capacitor Coled formed between the anode AND and the cathode CAT.

The first capacitor Cst is connected between a VDD line PL1 and the first node n1. The second capacitor Cand is connected between the third node n3 and the fourth node n4.

The first switch element M1 is turned on according to a gate-on voltage VGL of an $N^{th}$ scan signal SCAN(N) to connect the first node n1 and the third node n3. The $N^{th}$ scan signal SCAN(N) is supplied to pixels P through a second gate line GL2. In order to suppress a leakage current of the first switch element M1, the first switch element M1 may be implemented as a transistor having a dual gate structure in which two transistors are connected in series.

The second switch element M2 is turned on according to the gate-on voltage VGL of the $N^{th}$ scan signal SCAN(N) to connect a data line DL to the second node n2. The third switch element M3 is turned on according to the gate-on voltage VGL of an EM signal EM(N) to connect the VDD line PL1 to the first electrode of the driving element DT. The EM signal EM(N) is supplied to the pixel circuit through a third gate line GL3. The fourth switch element M4 is turned on according to the gate-on voltage VGL of the EM signal EM(N) to connect the third node n3 to the fourth node n4.

The fifth switch element M5 is turned on according to the gate-on voltage VGL of an $(N-1)^{th}$ scan signal SCAN(N−1) to connect the first node n1 to a Vini line PL3. The fifth switch element M5 includes a gate electrode connected to a first gate line GL1, a first electrode connected to the first node n1, and a second electrode connected to the Vini line PL3. The $(N-1)^{th}$ scan signal SCAN(N−1) is supplied to the pixel circuit through the first gate line GL1. In order to suppress a leakage current of the fifth switch element M5, the fifth switch element M5 may be implemented as a transistor having a dual gate structure in which two transistors are connected in series.

The sixth switch element M6 is turned on according to the gate-on voltage VGL of the $N^{th}$ scan signal SCAN(N) to connect a second Vini line PL32 to the fourth node n4. The sixth switch element M6 includes a gate electrode connected to the second gate line GL2, a first electrode connected to the second Vini line PL32, and a second electrode connected to the fourth node n4.

The seventh switch element M7 is turned on according to the gate-on voltage VGL of the EM signal EM(N) to connect the VDD line PL1 to a fifth node n5. A gate electrode of the seventh switch element M7 is connected to the third gate line GL3 to which the EM signal EM(N) is applied. A first electrode of the seventh switch element M7 is connected to the VDD line PL1, and a second electrode thereof is connected to the fifth node n5. The fifth node n5 is connected to the first capacitor Cst, the second electrode of the seventh switch element M7, a second electrode of the eighth switch element M8, and a second electrode of the ninth switch element M9. The seventh switch element M7 is turned on in an emission step Tem to apply a pixel driving voltage VDD to the first node n1 so that a gate-source voltage of the driving element DT is set to Vref-Vdata. Therefore, in the present disclosure, a current flowing in the light-emitting element OLED through the driving element DT in the emission step Tem using the seventh switch element M7 is not affected by VDD, thereby preventing a luminance deviation due to an IR drop of VDD.

The eighth switch element M8 is turned on in an initialization step Ti according to the gate-on voltage VGL of the $(N-1)^{th}$ scan signal SCAN(N−1) to connect a Vref line (reference voltage line) PL4, to which a reference voltage Vref is applied, to the fifth node n5. A gate electrode of the eighth switch element M8 is connected to the first gate line GL1 to which the $(N-1)^{th}$ scan signal SCAN(N−1) is applied. A first electrode of the eighth switch element M8 is connected to the Vref line PL4, and the second electrode thereof is connected to the fifth node n5.

The ninth switch element M9 is turned on in a sampling step Ts according to the gate-on voltage VGL of the $N^{th}$ scan signal SCAN(N) to connect the Vref line PL4, to which the reference voltage Vref is applied, to the fifth node n5. A gate electrode of the ninth switch element M9 is connected to the second gate line GL2 to which the $N^{th}$ scan signal SCAN(N) is applied. A first electrode of the ninth switch element M9 is connected to the Vref line PL4, and the second electrode thereof is connected to the fifth node n5.

The eighth and ninth switch elements M8 and M9 maintain a voltage of the fifth node n5 as the reference voltage Vref in the initialization step Ti and the sampling step Ts.

The pixel circuit compensates for a data voltage Vdata by as much as a threshold voltage Vth by sampling the threshold voltage Vth of the driving element DT in real time in each of subpixels. In the case of the pixel circuit, since the reference voltage Vref is applied to the first capacitor Cst, even when the capacitor Cst is short-circuited in a manufacturing process, dark spot defects are not caused, thereby not having a significant adverse effect on image quality. In particular, in the pixel circuit shown in FIG. 3, a voltage of the data line DL may be applied directly to the driving element DT to sample the threshold voltage Vth of the driving element DT, and an IR drop of the pixel driving voltage VDD may be compensated for to improve a luminance deviation according to a screen position.

FIG. 13 is a waveform diagram illustrating a driving method of the pixel circuit shown in FIG. 12. In FIG. 13, DTG denotes a gate voltage of the driving element DT, and DTS denotes a voltage of the first electrode (or source electrode) of the driving element DT.

Referring to FIG. 13, in the initialization step Ti, the $(N-1)^{th}$ scan signal SCAN(N−1) is generated as a pulse of the gate-on voltage VGL. In this case, the $N^{th}$ scan signal SCAN(N) and the $N^{th}$ EM signal EM(N) maintain a gate-off voltage VGH. Accordingly, in the initialization step Ti, the fifth and eighth switch elements M5 and M8 are turned on, and the remaining switch elements M1 to M4, M6, M7, and M9 maintain an off state.

The sampling step Ts of an $(N-1)^{th}$ pixel line and the initialization step Ti of the $(N-1)^{th}$ pixel line are simultaneously (or substantially simultaneously) generated by the $(N-1)^{th}$ scan signal SCAN(N−1). The $(N-1)^{th}$ scan signal SCAN(N−1) is synchronized with the data voltage Vdata to be written to subpixels of the $(N-1)^{th}$ pixel line to supply the data voltage Vdata to the first node n1 of the subpixels disposed on the $(N-1)^{th}$ pixel line. At the same time, the $(N-1)^{th}$ scan signal SCAN(N−1) supplies the pixel driving voltage VDD to the fifth node n5 in subpixels of an $N^{th}$ pixel line.

In the initialization step Ti, a voltage of the second node n2, that is, a first electrode voltage of the driving element DT, is in a floating state because the second and third switch elements M2 and M3 are in an off state. A voltage of the first node n1 is initialized to the first initialization voltage Vini1 because the fifth switch element M5 is turned on in the initialization step Ti. A voltage of the fifth node n5 is the pixel driving voltage VDD because the eighth switch element M8 is turned on in the initialization step Ti.

In the sampling step Ts, the $N^{th}$ scan signal SCAN(N) is generated as a pulse of the gate-on voltage VGL, and the data voltage Vdata to be written to the subpixels of the $N^{th}$ pixel line is output from a data driver 110. In this case, the $(N-1)^{th}$ scan signal SCAN(N−1) is inverted to the gate-off voltage VGH, and the $N^{th}$ signal EM(N) maintains the gate-off voltage VGH. Accordingly, in the sampling step Ts, the first, second, sixth, and ninth switch elements M1, M2, M6, and M9 are turned on, and the remaining switch elements M3, M4, M5, and M7, and M8 maintain an off state.

In the sampling step Ts of the $N^{th}$ pixel line, the data voltage Vdata to be written to the subpixels of the $N^{th}$ pixel line is synchronized with a pulse of the $N^{th}$ scan signal SCAN(N), thereby being supplied to the second node n2 of the subpixels disposed on the $N^{th}$ pixel line.

In the sampling step Ts, the first switch element M1 is turned on to connect the gate electrode and the second electrode of the driving element DT. In the sampling step T, since the first node n1 and the third node n3 are connected through the first switch element M1, when a voltage of the third node n3 is increased to the data voltage Vdata through the driving element DT, a voltage of the first node n1 is increased. In the sampling step Ts, when the gate voltage DTG of the driving element DT is increased to reach an absolute value (|Vth|) of the threshold voltage Vth of the driving element DT, the driving element DT is turned on. Accordingly, in the sampling step Ts and a holding step Th, Vref−(Vdata−|Vth|) is stored in the first capacitor Cst so that the threshold voltage Vth of the driving element DT is sampled. The first switch element M1 should be turned off in the emission step Tem to maintain an off state such that a current flowing through the driving element DT flows to the light-emitting element OLED.

In the sampling step Ts, a voltage DTS of the second node n2 is the data voltage Vdata because the second switch element M2 is turned on and the third switch element M3 is in an off state. A voltage of the second node n2, that is, the gate voltage DTG of the driving element DT, is changed from Vref−VDD+Vini1 to Vdata−|Vth| in the sampling step Ts. In the sampling step Ts, since the reference voltage Vref is applied through the eighth switch element M8, a voltage of the fifth node n5 is lowered from VDD to Vref. In the sampling step Ts, a voltage of the first node n1 drops by as much as a degree, in which the voltage of the fifth node n5 is lowered from VDD to Vref, through a capacitor coupling when the fifth switch element M5 is turned off, thereby being lowered to Vref−VDD+Vini1 and then changed into Vdata−|Vth|.

In the holding step Th, the gate signals SCAN(N−1), SCAN(N), and EM(N) maintain the gate-off voltage VGH so that all the switch elements M1 to M9 maintain an off state. Accordingly, the main nodes n1 to n5 of the pixel circuit are floated to maintain a threshold voltage sensing operation of the driving element DT.

In the emission step Tem, the $N^{th}$ EM signal EM(N) is inverted to the gate-on voltage VGL. In this case, the scan signals SCAN(N−1) and SCAN(N) maintain the gate-off voltage VGH. Accordingly, in the emission step Tem, the third, fourth, and seventh switch elements M3, M4, and M7 are turned on, and the remaining switch elements M1, M2, M5, M8, and M9 maintain an off state.

In the emission step Tem, voltages of the first and fifth nodes n1 and n5 are changed into VDD due to the pixel driving voltage VDD supplied through the third and ninth switch elements M2 and M9. A voltage of the second node n1, that is, the gate voltage DTG of the driving element DT, is changed into VDD−Vref+Vdata−|Vth| in the emission step Tem. In the emission step Tem, as shown in Equations below, since a current Ioled of the light-emitting element OLED is not affected by the threshold voltage Vth of the driving element DT, the current Ioled compensates for a diurnal variation of the driving element DT or a deviation in the threshold voltage Vth between the pixels and is not affected by a change in the pixel driving voltage VDD due to the IR drop of the pixel driving voltage VDD.

$$I_{OLED}=K/2(Vgs+|Vth|)^2=K(Vg-Vs+|Vth|)^2=K(VDD-Vref+VDD-|Vth|-VDD+|Vth|)^2=K(Vdata-|Vth|)^2$$

Here, K refers to a proportional constant determined by charge mobility, parasitic capacitance, and channel capacitance of the driving element DT. Vgs refers to a gate-source voltage of the driving element DT.

In the present disclosure, by adding a capacitor between a driving element and an anode of a light-emitting element, a charging delay of a low gradation voltage can be reduced or minimized using a capacitor coupling effect in a sampling step. Accordingly, in the present disclosure, a separate optical compensation algorithm is not required in order to improve low gradation expression characteristics, it is possible to improve the low gradation expression characteristics, and it is possible to reduce a flicker in a low speed driving mode.

Furthermore, in the present disclosure, when a data voltage has a large fluctuation range, for example, when the data voltage is changed from a black gradation voltage to a white gradation voltage, a response delay can be reduced or minimized to improve response characteristics.

The effects of the present disclosure are not limited to the effects described above, and other effects can be clearly understood from the description of the claims by those skilled in the art.

The present disclosure may include the at least the following embodiments further to the embodiments described thus far.

Scheme 1. A pixel circuit comprising:

- a light-emitting element including an anode and a cathode;
- a driving element which includes a gate electrode connected to a first node, a first electrode connected to a second node, and a second electrode connected to a third node and which supplies a current to the light-emitting element;
- a first switch element configured to connect the first node to the third node in a sampling step;
- a second switch element configured to supply a data voltage to the second node in the sampling step;
- a third switch element configured to supply a pixel driving voltage to the second node in a emission step after the sampling step;
- a fourth switch element configured to connect the third node to the anode of the light-emitting element in the emission step;
- a first capacitor connected to the first node;
- a second capacitor connected between the third node and the anode of the light-emitting element; and
- a third capacitor connected between the anode and the cathode of the light-emitting element.

Scheme 2. The pixel circuit of Scheme 1, wherein a capacitance ratio of the second capacitor to the first capacitor or the third capacitor is less than or equal to 1:1.

Scheme 3. The pixel circuit of Scheme 2, wherein the second capacitor has a capacitance that is greater than or equal to 1/10 of a capacitance of the first capacitor or the third capacitor.

Scheme 4. The pixel circuit of Scheme 1, wherein the second capacitor has different capacitances in a red subpixel, a green subpixel, and a blue subpixel including the pixel circuit.

Scheme 5. The pixel circuit of Scheme 2, wherein the capacitance of the second capacitor in the blue subpixel >the capacitance of the second capacitor in the red subpixel >the capacitance of the second capacitor in the green subpixel.

Scheme 6. The pixel circuit of Scheme 1, wherein the second capacitor has a capacitance that is greater than a parasitic capacitance between the driving element and the light-emitting element.

Scheme 7. The pixel circuit of Scheme 1, wherein the first and second switch elements are simultaneously or substantially simultaneously turned on in the sampling step in response to an $N^{th}$ scan signal generated as a pulse of a gate-on voltage, wherein N is a positive integer which is greater than or equal to 1, and the third and fourth switch elements maintain an off state according to an emitting, EM, signal generated as a pulse of a gate-off voltage from an initialization step before the sampling step to the start of the emission step and are turned on in the emission step in which the EM signal is changed into the gate-on voltage. Alternatively, the first and second switches can be in the on position concurrently and do not need to be turned on simultaneously.

Scheme 8. The pixel circuit of Scheme 7, further comprising:

a fifth switch element turned on in the initialization step according to an $(N-1)^{th}$ scan signal generated as the pulse of the gate-on voltage to connect the first node to an initialization voltage line to which an initialization voltage is applied; and a sixth switch element turned on in the sampling step according to the gate-on voltage of the $N^{th}$ scan signal to connect the Initialization voltage line to a fourth node to which the anode of the light-emitting element is connected.

Scheme 9. The pixel circuit of Scheme 8, wherein the initialization voltage includes a first initialization voltage for initializing the driving element and a second initialization voltage for initializing the light-emitting element, the fifth switch element is turned on according to the gate-on voltage of the $(N-1)^{th}$ scan signal to connect the first node to a first Initialization voltage line to which the first initialization voltage is applied, and the sixth switch element is turned on according to the gate-on voltage of the $N^{th}$ scan signal to connect a second Initialization voltage line, to which the second initialization voltage is applied, to the fourth node.

Scheme 10. The pixel circuit of Scheme 9, further comprising a seventh switch element turned on in the emission step according to the gate-on voltage of the EM signal to connect a pixel driving voltage line, to which the pixel driving voltage is applied, to a fifth node to which the first capacitor is connected.

Scheme 11. The pixel circuit of Scheme 10, further comprising:

an eighth switch element turned on in the initialization step according to the gate-on voltage of the $(N-1)^{th}$ scan signal to connect a reference voltage line, to which a reference voltage is applied, to the fifth node; and a ninth switch element turned on in the sampling step according to the gate-on voltage of the $N^{th}$ scan signal to connect the reference voltage line to the fifth node.

Scheme 12. A display device comprising:

a data driver configured to supply data voltages to data lines;

a gate driver configured to supply an $(N-1)^{th}$ scan signal generated as a pulse of a gate-on voltage to a first gate line in an initialization step, supply an $N^{th}$ scan signal generated as the pulse of the gate-on voltage to a second gate line in a sampling step after the initialization step, and supply an emitting signal generated as the gate-on voltage to a third gate line in a emission step after the sampling step, wherein N is a positive integer which is greater than or equal to 1;

a power source configured to output a pixel driving voltage and a low potential power voltage and an initialization voltage which are lower than the pixel driving voltage; and a red subpixel, a green subpixel, and a blue subpixel including pixel circuits connected to the data lines and the first gate line to the third gate line, wherein the pixel circuit includes:

a light-emitting element including an anode and a cathode;

a driving element which includes a gate electrode connected to a first node, a first electrode connected to a second node, and a second electrode connected to a third node and which supplies a current to the light-emitting element;

a first switch element configured to connect the first node to the third node in the sampling step;

a second switch element configured to supply the data voltage to the second node in the sampling step;

a third switch element configured to supply the pixel driving voltage to the second node in the emission step after the sampling step;

a fourth switch element configured to connect the third node to the anode of the light-emitting element in the emission step;

a first capacitor connected to the first node;

a second capacitor connected between the third node and the anode of the light-emitting element; and a third capacitor connected between the anode and the cathode of the light-emitting element.

Scheme 13. The display device of Scheme 12, wherein the second capacitor has different capacitances in the red subpixel, the green subpixel, and the blue subpixel Scheme 14. The display device of Scheme 13, wherein the capacitance of the second capacitor in the blue subpixel >the capacitance of the second capacitor in the red subpixel >the capacitance of the second capacitor in the green subpixel.

Scheme 15. A display device including above pixel circuit.

The objects to be achieved by the present disclosure, the means for achieving the objects, and effects of the present disclosure described above do not specify essential features of the claims, and thus, the scope of the claims is not limited to the disclosure of the present disclosure.

Although the embodiments of the present disclosure have been described in more detail with reference to the accompanying drawings, the present disclosure is not limited thereto and may be embodied in many different forms without departing from the technical concept of the present disclosure. Therefore, the embodiments disclosed in the present disclosure are provided for illustrative purposes only and are not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A pixel circuit comprising:

a light-emitting element including an anode and a cathode;

a driving element which includes a gate electrode connected to a first node, a first electrode connected to a second node, and a second electrode connected to a third node, the driving element configured to supply a current to the light-emitting element;

a first switch element configured to connect the first node to the third node in a sampling step;

a second switch element configured to supply a data voltage to the second node in the sampling step;

a third switch element configured to supply a pixel driving voltage to the second node in a emission step after the sampling step;

a fourth switch element configured to connect the third node to the anode of the light-emitting element in the emission step;

a first capacitor connected to the first node;

a second capacitor connected between the third node and the anode of the light-emitting element; and a third capacitor connected between the anode and the cathode of the light-emitting element.

2. The pixel circuit of claim 1, wherein the first and second switch elements are substantially simultaneously turned on in the sampling step in response to an Nth scan signal generated as a pulse of a gate-on voltage, wherein N is a positive integer which is greater than or equal to 1, and wherein the third and fourth switch elements maintain an off state according to an emitting signal generated as a pulse of a gate-off voltage from an initialization step before the sampling step to the start of the emission step and are turned on in the emission step in which the emitting signal is changed into the gate-on voltage.

3. The pixel circuit of claim 2, further comprising:

a fifth switch element turned on in the initialization step according to an (N−1)th scan signal generated as the pulse of the gate-on voltage to connect the first node to an initialization voltage line to which an initialization voltage is applied; and a sixth switch element turned on in the sampling step according to the gate-on voltage of the Nth scan signal to connect the Initialization voltage line to a fourth node to which the anode of the light-emitting element is connected.

4. The pixel circuit of claim 3, wherein the initialization voltage includes a first initialization voltage for initializing the driving element and a second initialization voltage for initializing the light-emitting element, wherein the fifth switch element is turned on according to the gate-on voltage of the (N−1)th scan signal to connect the first node to a first Initialization voltage line to which the first initialization voltage is applied, and wherein the sixth switch element is turned on according to the gate-on voltage of the Nth scan signal to connect a second Initialization voltage line, to which the second initialization voltage is applied, to the fourth node.

5. The pixel circuit of claim 4, further comprising a seventh switch element turned on in the emission step according to the gate-on voltage of the emitting signal to connect a pixel driving voltage line, to which the pixel driving voltage is applied, to a fifth node to which the first capacitor is connected.

6. The pixel circuit of claim 5, further comprising:

an eighth switch element turned on in the initialization step according to the gate-on voltage of the (N−1)th scan signal to connect a reference voltage line, to which a reference voltage is applied, to the fifth node; and a ninth switch element turned on in the sampling step according to the gate-on voltage of the Nth scan signal to connect the reference voltage line to the fifth node.

7. The pixel circuit of claim 1, wherein a capacitance ratio of the second capacitor to the first capacitor or the third capacitor is less than or equal to 1:1.

8. The pixel circuit of claim 7, wherein the second capacitor has a capacitance that is greater than or equal to 1/10 of a capacitance of either the first capacitor or the third capacitor.

9. The pixel circuit of claim 1, wherein the second capacitor has different capacitances in a red subpixel, a green subpixel, and a blue subpixel including the pixel circuit.

10. The pixel circuit of claim 9, wherein the capacitance of the second capacitor in the blue subpixel is greater than the capacitance of the second capacitor in the red subpixel, and the capacitance of the second capacitor in the red subpixel is greater than the capacitance of the second capacitor in the green subpixel.

11. The pixel circuit of claim 1, wherein the second capacitor has a capacitance that is greater than a parasitic capacitance between the driving element and the light-emitting element.

12. A display device including the pixel circuit of claim 1.

13. A display device comprising:

a data driver configured to supply data voltages to data lines;

a gate driver configured to supply an (N−1)th scan signal generated as a pulse of a gate-on voltage to a first gate line in an initialization step, supply an Nth scan signal generated as the pulse of the gate-on voltage to a second gate line in a sampling step after the initialization step, and supply an emitting signal generated as the gate-on voltage to a third gate line in a emission step after the sampling step, wherein N is a positive integer which is greater than or equal to 1;

a power source configured to output a pixel driving voltage and a low potential power voltage and an initialization voltage which are lower than the pixel driving voltage; and a red subpixel, a green subpixel, and a blue subpixel including pixel circuits connected to the data lines and the first gate line to the third gate line, wherein the pixel circuit includes:

a light-emitting element including an anode and a cathode;

a driving element which includes a gate electrode connected to a first node, a first electrode connected to a second node, and a second electrode connected to a third node and which supplies a current to the light-emitting element;

a first switch element configured to connect the first node to the third node in the sampling step;

a second switch element configured to supply the data voltage to the second node in the sampling step;

a third switch element configured to supply the pixel driving voltage to the second node in the emission step after the sampling step;

a fourth switch element configured to connect the third node to the anode of the light-emitting element in the emission step;

a first capacitor connected to the first node;

a second capacitor connected between the third node and the anode of the light-emitting element; and a third capacitor connected between the anode and the cathode of the light-emitting element.

14. The display device of claim 13, wherein the second capacitor has different capacitances in the red subpixel, the green subpixel, and the blue subpixel.

15. The display device of claim 14, wherein the capacitance of the second capacitor in the blue subpixel is greater than the capacitance of the second capacitor in the red subpixel, and the capacitance of the second capacitor in the red subpixel is greater than the capacitance of the second capacitor in the green subpixel.

* * * * *